US011078745B2

(12) United States Patent
Getzlaf et al.

(10) Patent No.: US 11,078,745 B2
(45) Date of Patent: Aug. 3, 2021

(54) APPARATUSES AND METHODS FOR ENABLING MULTISTAGE HYDRAULIC FRACTURING

(71) Applicant: NCS Multistage Inc., Calgary (CA)

(72) Inventors: Don Getzlaf, Calgary (CA); Tim Johnson, Calgary (CA); Brock Gillis, Calgary (CA)

(73) Assignee: NCS Multistage Inc., Calgary (CA)

( * ) Notice: Subject to any disclaimer, the term of this patent is extended or adjusted under 35 U.S.C. 154(b) by 265 days.

(21) Appl. No.: 16/406,800

(22) Filed: May 8, 2019

(65) Prior Publication Data

US 2020/0131878 A1 Apr. 30, 2020

Related U.S. Application Data

(63) Continuation of application No. 15/348,398, filed on Nov. 10, 2016, now Pat. No. 10,329,867.

(60) Provisional application No. 62/253,435, filed on Nov. 10, 2015.

(51) Int. Cl.

| | |
|---|---|
| ***E21B 34/14*** | (2006.01) |
| ***E21B 33/124*** | (2006.01) |
| ***E21B 43/14*** | (2006.01) |
| ***E21B 34/06*** | (2006.01) |
| ***E21B 43/12*** | (2006.01) |

(52) U.S. Cl.

CPC ..... *E21B 33/124* (2013.01); *E21B 34/06* (2013.01); *E21B 34/14* (2013.01); *E21B 43/126* (2013.01); *E21B 43/14* (2013.01)

(58) Field of Classification Search

CPC ..... E21B 34/14; E21B 33/124; E21B 43/14; E21B 34/06; E21B 43/26

See application file for complete search history.

(56) References Cited

U.S. PATENT DOCUMENTS

| | | | |
|---|---|---|---|
| 4,457,376 | A | 7/1984 | Carmody et al. |
| 6,920,930 | B2 | 7/2005 | Allamon et al. |
| 7,434,625 | B2 | 10/2008 | Adams |
| 8,505,632 | B2 | 8/2013 | Guerrero et al. |
| 9,534,460 | B2 | 1/2017 | Watson et al. |

(Continued)

OTHER PUBLICATIONS

Non-Final Rejection issued in U.S. Appl. No. 15/348,398 dated Sep. 18, 2018.

*Primary Examiner* — Steven A MacDonald

(57) ABSTRACT

There is provided a plurality of injection stations, wherein each one of the injection stations, independently, comprising: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations.

22 Claims, 12 Drawing Sheets

(56) References Cited

U.S. PATENT DOCUMENTS

| | | | |
|---|---|---|---|
| 9,546,538 | B2 | 1/2017 | Hulsewe et al. |
| 2006/0124312 | A1 | 6/2006 | Rytlewski et al. |
| 2012/0085548 | A1 | 4/2012 | Fleckenstein et al. |
| 2013/0118732 | A1 | 5/2013 | Chauffe et al. |
| 2013/0206402 | A1 | 8/2013 | Coon |
| 2014/0138101 | A1 | 5/2014 | Arabsky et al. |
| 2015/0034332 | A1 | 2/2015 | Merron |
| 2015/0267506 | A1 | 9/2015 | Avery |
| 2016/0040508 | A1 | 2/2016 | Webster et al. |
| 2016/0145970 | A1 | 5/2016 | Armistead |

1311B
DETAIL F 118
132
DETAIL G 102
108
136
104
DETAIL E 110B
108
106
109
111
104
110A
102
DETAIL H
102C
100
142
105B
138
129
102B
102
SECTION A-A
104

136
130
E
108
106
H
105A
102A
112
101
A
F
132
G
118
131
129
1311A
100
A

SECTION B-B

SECTION AA-AA

APPARATUSES AND METHODS FOR ENABLING MULTISTAGE HYDRAULIC FRACTURING

CROSS-REFERENCE TO RELATED APPLICATION

This application is a continuation of U.S. patent application Ser. No. 15/348,398 filed Nov. 10, 2016, which claims the benefits of priority to U.S. Provisional Patent Application No. 62/253,435, filed Nov. 10, 2015, titled "APPARATUSES AND METHODS FOR ENABLING MULTISTAGE HYDRAULIC FRACTURING". The contents of the above-referenced application is incorporated into the present application by reference.

FIELD

The present disclosure relates to flow control apparatuses which are deployable within a wellbore for controlling supply of treatment fluid to the reservoir.

BACKGROUND

Mechanical actuation of downhole valves can be relatively difficult, owing to the difficulty in deploying shifting tools on coiled tubing, or conventional ball drop systems, for actuating such valves, especially in deviated wellbores. When using conventional ball drop systems, the number of stages that are able to be treated are limited.

SUMMARY

In one aspect, there is provided a plurality of injection stations, wherein each one of the injection stations, independently, comprising: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

In another aspect, there is provided a pair of injection stations comprising: a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured for receiving a first plug for seating of the first plug over the first aperture when deployed in a deployed position; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed in a deployed position, the second seat is configured for receiving a second plug for seating of the second plug over the second aperture of the second seat; a deployable second seat, mounted to the second housing, and including a second aperture, and configured for receiving a second plug for seating of the second plug over the second aperture when deployed in a deployed position; wherein: the first and second injection stations are integrable within a wellbore string such that the wellbore string includes the first and second longitudinally spaced-apart injection stations; the second aperture is configured to co-operate with the first plug such that, when the first and second injection stations are integrated within a wellbore string such that the wellbore string includes the first and second longitudinally spaced-apart injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat.

In another aspect, there is provided a plurality of injection stations, each one of the injection stations, independently, comprising: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it.

In another aspect, there is provided a plurality of injection stations, each one of the injection stations, independently, comprising: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that when the wellbore string is disposed within a wellbore, each successive deployable seat of the one or more uphole deployable seats, in an uphole direction, is configured to seat a larger plug than the seat immediately below it.

In another aspect, there is provided a plurality of injection system kits, wherein each one of the injection system kits, independently, comprises: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is cooperable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

In another aspect, there is provided a pair of injection system kits comprising: a first injection system kit including: a first plug, a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured such that, when the first seat is deployed in a deployed position, the first seat is configured for receiving the first plug for seating of the first plug over the first aperture of the first seat; a second injection system kit including: a second plug; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed in a deployed position, the second seat is configured for receiving the second plug for seating of the second plug over the second aperture of the second seat; wherein the first and second injection stations are integrable within a wellbore string such that the wellbore string includes longitudinally spaced apart first and second injection stations, such that the second aperture is configured to co-operate with the first plug such that, when the wellbore string includes longitudinally spaced apart first and second injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat.

In another aspect, there is provided a plurality of injection system kits, wherein each one of the injection system kits, independently, comprises: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it.

In another aspect, there is provided a plurality of injection system kits, wherein each one of the injection system kits, independently, comprises: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, is configured to seat a larger plug than the seat immediately below it.

In another aspect, there is provided a plurality of injection stations configured for integration within a wellbore string comprising: a first set of injection stations, wherein each one of the first set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including a aperture, and configured such that, when the seat is deployed in a deployed position, the first seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective and a second set of injection stations, wherein each one of the second set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

In another aspect, there is provided a plurality of injection stations configured for intregration within a wellbore string comprising: a first set of injection stations including: a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured such that, when the first seat is deployed, the first seat is configured for receiving a first plug for seating of the first plug over the first aperture of the first seat; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed, the second seat is configured for receiving a second plug for seating of the second plug over the second aperture of the second seat; wherein the first and second injection stations are integrable within a wellbore string such that the wellbore string includes longitudinally spaced apart first and second injection stations, such that the second aperture is configured to co-operate with the first plug such that, when the wellbore string includes longitudinally spaced apart first and second injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat; and a second set of injection stations including: a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured such that, when the first seat is deployed, the first seat is configured for receiving a first plug for seating of the first plug over the first aperture of the first seat; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed, the second seat is configured for receiving a second plug for seating of the second plug over the second aperture of the second seat; wherein the first and second injection stations are integrable within a wellbore string such that the wellbore string includes longitudinally spaced apart first and second injection stations, such that the second aperture is configured to co-operate with the first plug such that, when the wellbore string includes longitudinally spaced apart first and second injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat.

In another aspect, there is provided a plurality of injection stations configured for integration within a wellbore string comprising: a first set of injection stations, wherein each one of the first set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including a aperture, and configured such that, when the seat is deployed in a deployed position, the first seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it; and a second set of injection stations, wherein each one of the second set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it.

In another aspect, there is provided a plurality of injection stations configured for integration within a wellbore string comprising: a first set of injection stations, wherein each one of the first set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including a aperture, and configured such that, when the seat is deployed in a deployed position, the first seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that when the wellbore string is disposed within a wellbore, each successive deployable seat of the one or more uphole deployable seats, in an uphole direction, is configured to seat a larger plug than the seat immediately below it and a second set of injection stations, wherein each one of the second set of injection stations includes: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving a respective plug for seating of the respective plug over the aperture of the seat; such that a plurality of plugs are respective to the injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that when the wellbore string is disposed within a wellbore, each successive deployable seat of the one or more uphole deployable seats, in an uphole direction, is configured to seat a larger plug than the seat immediately below it. In another aspect, there is provided a first and second sets of injection system kits comprising: a first set of injection system kits, wherein the first set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective and a second set of injection system kits, wherein the second set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integratable into a wellbore string such that the wellbore string includes a plurality of longitudinally spaced apart injection stations; the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations; for each one of the one or more uphole injection stations, independently: one or more injection stations are disposed downhole relative to the uphole injection station to define one or more downhole-disposed injection stations, wherein each one of the plugs that is respective to a one of the one or more downhole-disposed injection stations is a downhole-deployable plug; the longitudinally spaced apart injection stations are positionable in a sequence such that for each one of the one or more uphole injection stations, independently: the aperture of the seat of the uphole injection station is cooperable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently: when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

In another aspect, there is provided a plurality of injection system kits comprising: a first set of injection system kits including: a first injection system kit including: a first plug; a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured such that, when the first seat is deployed in a deployed position, the first seat is configured for receiving the first plug for seating of the first plug over the first aperture of the first seat; and a second injection system kit including: a second plug; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed in a deployed position, the second seat is configured for receiving the second plug for seating of the second plug over the second aperture of the second seat; wherein the first and second injection stations are integrable within a wellbore string such that the wellbore string includes longitudinally spaced apart first and second injection stations, such that the second aperture is configured to co-operate with the first plug such that, when the wellbore string includes longitudinally spaced apart first and second injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat and a second set of injection system kits including: a first injection system kit including: a first plug; a first injection station including: a first housing; a first port extending through the first housing; a first flow control member configured for displacement for effecting at least opening of the first port such that, when the first injection station is integrated within a wellbore string that is disposed within a wellbore of a subterranean formation, and treatment fluid is being supplied through a wellbore string passage of the wellbore string, injection of the supplied treatment fluid into the subterranean formation is effected through the first port; and a deployable first seat, mounted to the first housing, and including a first aperture, and configured such that, when the first seat is deployed in a deployed position, the first seat is configured for receiving the first plug for seating of the first plug over the first aperture of the first seat; and a second injection system kit including: a second plug; a second injection station including: a second housing; a second port extending through the second housing; a second flow control member configured for displacement for effecting at least opening of the second port such that, when the second injection station is integrated within a wellbore string that is disposed within a wellbore of a subterranean formation, and treatment fluid is being supplied through a wellbore string passage of the wellbore string, injection of the supplied treatment fluid into the subterranean formation is effected through the second port; and a deployable second seat, mounted to the second housing, and including a second aperture, and configured such that, when the second seat is deployed in a deployed position, the second seat is configured for receiving the second plug for seating of the second plug over the second aperture of the second seat; wherein the first and second injection stations are integrable within a wellbore string such that the wellbore string includes longitudinally spaced apart first and second injection stations, such that the second aperture is configured to co-operate with the first plug such that, when the wellbore string includes longitudinally spaced apart first and second injection stations, and when the wellbore string is disposed within a wellbore such that the second injection station is disposed uphole relative to the first injection station, and when both of the first and second seats are deployed, and when the first plug is being conducted downhole through the wellbore string passage, the first plug passes through the second aperture of the deployed second seat and is conducted downhole for seating on the deployed first seat.

In another aspect, there is provided a first and second sets of injection system kits comprising: a first set of injection system kits, wherein the first set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it and a second set of injection system kits, wherein the second set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that, when the wellbore string is disposed within a wellbore, each successive deployable seat of the one or more uphole deployable seats, in an uphole direction, includes a larger aperture than the seat immediately below it.

In another aspect, there is provided a first and second sets of injection system kits comprising: a first set of injection system kits, wherein the first set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that when the wellbore string is disposed within a wellbore, each successive deployable seat of the one or more uphole deployable seats, in an uphole direction, is configured to seat a larger plug than the seat immediately below it. and a second set of injection system kits, wherein the second set of injection system kits includes a plurality of injection system kits, wherein each one of the injection system kits, independently, includes: a plug; and an injection station including: a housing; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, mounted to the housing, and including an aperture, and configured such that, when the seat is deployed in a deployed position, the seat is configured for receiving the plug for seating of the plug over the aperture of the seat; wherein the plug is respective to the injection station; such that a plurality of plugs are respective to a plurality of injection stations, wherein each one of the plugs is respective to a deployable seat of a one of the injection stations, such that each one of the plugs is respective to a one of the injection stations; wherein: the injection stations are integrable within a wellbore string such that the wellbore string includes a plurality of longitudinally spaced apart deployable seats that are disposed in a sequence; the longitudinally spaced apart deployable seats include one or more uphole deployable seats, wherein each one of the one or more uphole deployable seats is a one of the one or more deployable seats of the longitudinally spaced apart deployable seats that is other than the deployable seat of the longitudinally spaced apart deployable seats that is disposed furthest downhole relative to all of the other ones of the longitudinally spaced apart deployable seats; and the sequence is such that when the wellbore string is disposed within a wellbore, each successive deployable seat of the one or more uphole deployable seats, in an uphole direction, is configured to seat a larger plug than the seat immediately below it.

In another aspect, there is provided an injection station comprising: a housing including a housing passage; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port via the housing passage; a deployable seat, mounted to the housing, and including an aperture, and biased for displacement to a deployed position, wherein, in the deployed position, the seat is configured for receiving the plug for seating of the plug over the aperture of the seat; and a first retainer for retaining the deployable seat in a non-deployed position, wherein the retainer is displaceable relative to the housing such that the seat becomes disposed in the deployed position.

In another aspect, there is provided an injection station comprising: a housing including a housing passage; a port extending through the housing; a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port via the housing passage; a deployable seat, mounted to the housing, and including an aperture, and biased for displacement to a deployed position, wherein, in the deployed position, the seat is configured for receiving the plug for seating of the plug over the aperture of the seat; and a piston for retaining the deployable seat in a non-deployed position, wherein the piston is displaceable relative to the housing such that the seat becomes disposed in the deployed position.

BRIEF DESCRIPTION OF DRAWINGS

The preferred embodiments will now be described with the following accompanying drawings, in which:

FIGS. 1A through F are various view of an embodiment of an injection station with the flow control member disposed in the closed position and the deployable seat disposed in the non-deployed position, wherein: FIG. 1A is a view from one side of an embodiment of an injection station, FIG. 1B is a sectional view of the injection station illustrated in FIG. 1A, FIG. 1C is a detailed view of Detail "H" illustrated in FIG. 1B, FIG. 1D is a detailed view of Detail "E" illustrated in FIG. 1B, FIG. 1E is a detailed view of Detail "G" illustrated in FIG. 1B, and FIG. 1F is a detailed view of Detail "F" illustrated in FIG. 1B;

FIGS. 2A through D are various view of the injection station illustrated in FIG. 1A, prior to actuation of a gas generator for effecting deployment of a seat, wherein FIG. 2A is a view from one side of the injection station, FIG. 2B is a sectional view of the injection station illustrated in FIG. 2A, FIG. 2C is a detailed view of Detail "J" illustrated in FIG. 2B, and FIG. 2D is a detailed view of Detail "P" illustrated in FIG. 2B;

FIGS. 3A through C are various view of the injection station illustrated in FIG. 1A, prior to actuation of gas generator for effecting deployment of a seat, with a flow communication control valve having been actuated by the gas generator for effecting deployment of the seat, wherein: FIG. 3A is a sectional view of the injection station illustrated in FIG. 1A, FIG. 3B is a detailed view of Detail "L" illustrated in FIG. 3A, and FIG. 3C is a detailed view of Detail "R" illustrated in FIG. 3A.

FIGS. 4A through C are various view of the injection station illustrated in FIG. 1A, with a piston having been displaced by pressurized fluid communicated via the flow communication control valve, and thereby enabling deployment of the seat, wherein: FIG. 4A is a sectional view of the injection station illustrated in FIG. 1A, FIG. 4B is a detailed view of Detail "N" illustrated in FIG. 3A, and FIG. 4C is a detailed view of Detail "T" illustrated in FIG. 3A;

FIGS. 5A through D are various view of the injection station illustrated in FIG. 1A, with the seat having been deployed, wherein FIG. 5A is a sectional view of the injection station illustrated in FIG. 1A, FIG. 5B is a detailed view of Detail "V" illustrated in FIG. 5A, and FIG. 5C is a detailed view of Detail "Y" illustrated in FIG. 5A, and FIG. 5D is a detailed view of Detail "W" illustrated in FIG. 5A;

FIGS. 6A through E are various view of an embodiment of an injection station with a ball having been landed on the deployed seat, wherein: FIG. 6A is a view from one side of an embodiment of an injection station, FIG. 6B is a sectional view of the injection station illustrated in FIG. 6A, FIG. 6C is a detailed view of Detail "AB" illustrated in FIG. 6B, FIG. 6D is a detailed view of Detail "AD" illustrated in FIG. 6B, and FIG. 6E is a detailed view of Detail "AC" illustrated in FIG. 6B;

FIGS. 7A through D are various view of the injection station illustrated in FIG. 1A, after a flow control member has been shifted to open a port, wherein: FIG. 7A is a sectional view of the injection station illustrated in FIG. 1A, FIG. 7B is a detailed view of Detail "AF" illustrated in FIG. 7A, FIG. 7C is a detailed view of Detail "AH" illustrated in FIG. 7A, and FIG. 7D is a detailed view of Detail "AG" illustrated in FIG. 7A FIGS. 8A through D are various view of the injection station illustrated in FIG. 1A, while flowback is occurring, wherein.

FIGS. 9A through D are various views of the injection station illustrated in FIG. 1A, with a second flow communication control valve having been actuated by a second gas generator for effecting retraction of the seat, wherein: FIG. 9A is a sectional view of the injection station illustrated in FIG. 1A, FIG. 9B is a detailed view of Detail "AP" illustrated in FIG. 9A, FIG. 9C is a detailed view of Detail "AT" illustrated in FIG. 9A, and FIG. 9D is a detailed view of Detail "AR" illustrated in FIG. 9A;

FIGS. 10A through D are various views of the injection station of FIG. 1 with the seat having been retracted, wherein: FIG. 10A is a sectional view of the injection station illustrated in FIG. 1A, FIG. 10B is a detailed view of Detail "AV" illustrated in FIG. 10A, FIG. 10C is a detailed view of Detail "AY" illustrated in FIG. 10A, and FIG. 10D is a detailed view of Detail "AW" illustrated in FIG. 10A;

DETAILED DESCRIPTION

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole" mean, relativistically, further away from the surface and in closer proximity to the bottom of the wellbore, when measured along the longitudinal axis of the wellbore.

Figure 11:
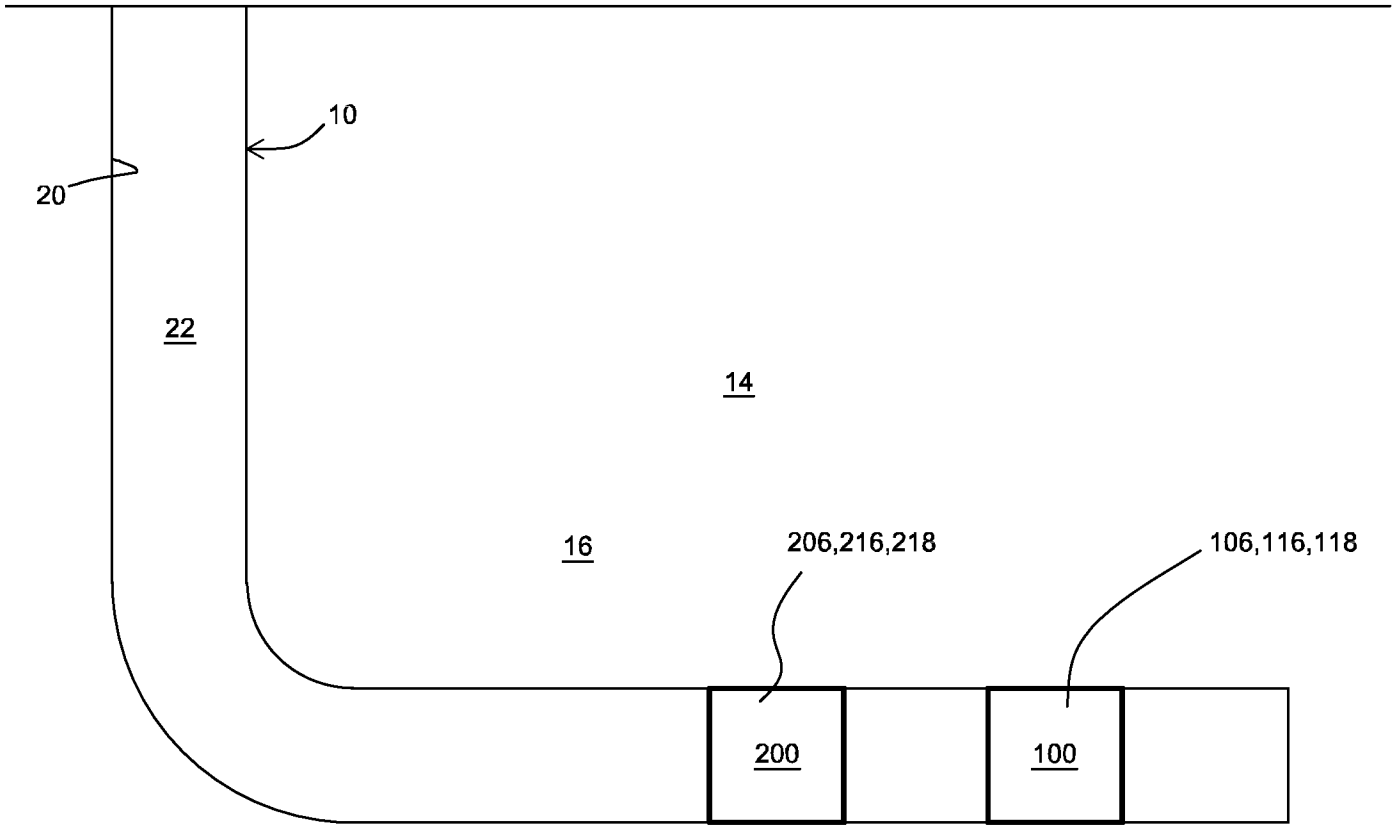
FIG. 11 is a schematic illustrator of two injection station of a first set, integrated within a wellbore string that has been deployed within a wellbore.
Figure 12:
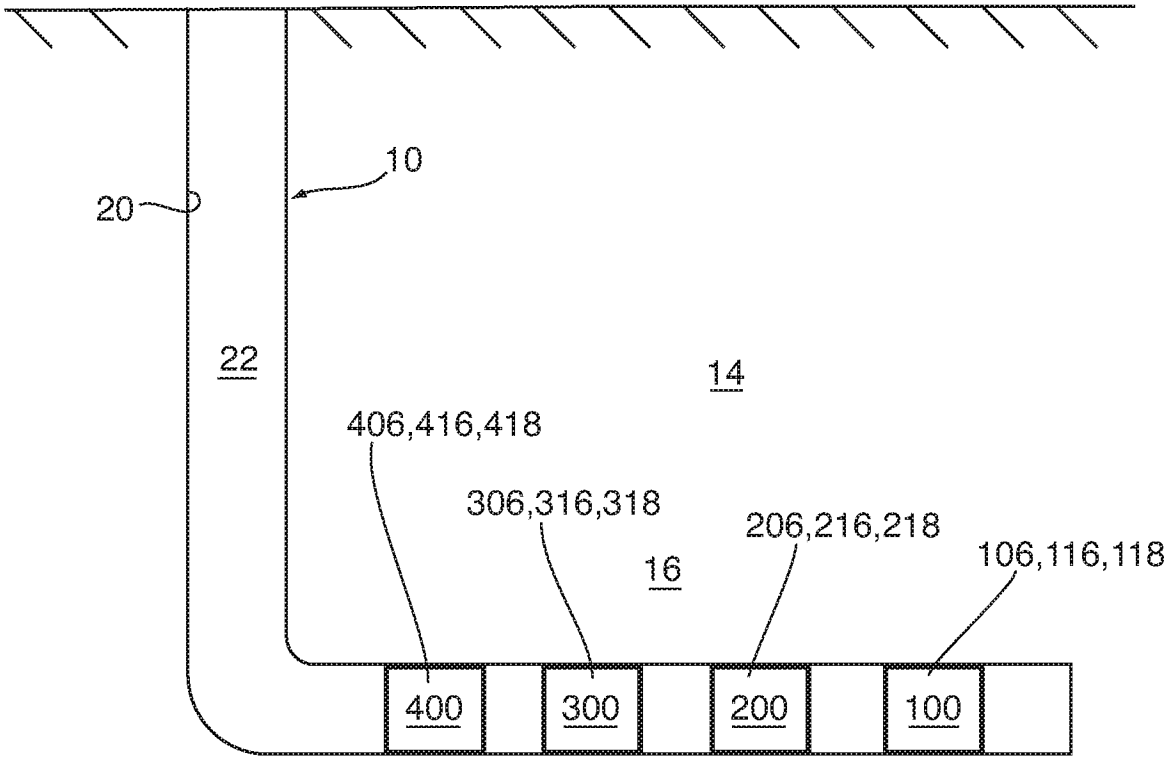
FIG. 12 is a schematic illustration of two sets of injection stations (each set having, respectively, two injection stations) integrated within a wellbore string that has been deployed within a wellbore.

Referring to FIGS. 11 and 12, there is provided a set of a plurality of injections stations. Each one of the injection stations is configured for effecting selective stimulation of a subterranean formation 14, such as a reservoir 16. The injection stations are deployable within a wellbore 10. Suitable wellbores 10 include vertical, horizontal, deviated or multi-lateral wells.

The stimulation is effected by supplying treatment material to the subterranean formation which may include a hydrocarbon-containing reservoir.

In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

In some embodiments, for example, the treatment material includes water, and is supplied for transporting (or "flowing", or "pumping") a wellbore tool (such as, for example, a plug) downhole.

The injection stations may be integrated within a wellbore string 20 that is deployable within the wellbore 10. Integration may be effected, for example, by way of threading or welding. The integration is such that the wellbore string includes a plurality of longitudinally spaced apart injection stations.

The wellbore string 20 may include pipe, casing, or liner, and may also include various forms of tubular segments, such as flow control apparatuses described herein. The wellbore string 20 defines a wellbore string passage 22.

Successive injection stations may be spaced from each other within the wellbore string 20 such that each injection stations is positioned adjacent a producing interval to be stimulated by fluid treatment effected by treatment material that may be supplied through a port (see below).

The following is a description of a single injection station 100 of a plurality of injection stations of the set, but is also descriptive of the other ones of the injection stations of the set.

Referring to FIGS. 1 to 10, in some embodiments, for example, the injection station 100 includes a flow control apparatus 101. In some embodiments, for example, the flow control apparatus 101 includes a housing 102. A passage 104 is defined within the housing 102. The passage 104 is configured for conducting treatment material that is received from a supply source (such as at the surface) to a port 106 that extends through the housing 102.

In some embodiments, for example, the housing 102 includes interconnected upper and lower cross-over subs 102A, 102C, and intermediate outer housing section 102B. The intermediate housing section 102B is disposed between the upper and lower crossover subs 102A, 102B. In some embodiments, for example, the intermediate housing section 102B is disposed between the upper and lower crossover subs 102A, 102B, and is joined to both of the upper and lower crossover subs with threaded connections. Axial and torsional forces may be translated from the upper crossover sub 102A to the lower crossover sub 102C via the intermediate housing section 102B.

The housing 102 is coupled (such as, for example, threaded) to other segments of the wellbore string 20, such that the wellbore string passage 22 includes the housing passage 104. In some embodiments, for example, the wellbore string 20 is lining the wellbore. The wellbore string 20 is provided for, amongst other things, supporting the subterranean formation within which the wellbore is disposed.

The wellbore string may include multiple segments, and segments may be connected (such as by a threaded connection).

In some embodiments, for example, it is desirable to inject treatment material into a predetermined zone (or "interval") of the subterranean formation 14 via the wellbore 10. In this respect, the treatment material is supplied into the wellbore 10, and the flow of the supplied treatment material is controlled such that a sufficient fraction of the supplied treatment material (in some embodiments, all, or substantially all, of the supplied treatment material) is directed, via the port 106, to the predetermined zone. In some embodiments, for example, the port 106 extends through the housing 102. During treatment, the port 106 effects fluid communication between the passage 104 and the subterranean formation 14. In this respect, during treatment, treatment material being conducted from the treatment material source via the passage 104 is supplied to the subterranean formation 14 via the port 106.

As a corollary, the flow of the supplied treatment material is controlled such that injection of the injected treatment material to another zone of the subterranean formation is prevented, substantially prevented, or at least interfered with. The controlling of the flow of the supplied treatment material, within the wellbore 10, is effected, at least in part, by the flow control apparatus 101.

In some embodiments, for example, conduction of the supplied treatment to other than the predetermined zone may be effected, notwithstanding the flow control apparatus 101, through an annulus, that is formed within the wellbore, between the casing and the subterranean formation. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port 106 and the remote zone, is prevented, or substantially prevented, or at least interfered with, by a zonal isolation material. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the port 106, or of any cement that has become disposed within the port, prior to cementing, the port may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2TM grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the flow control apparatus 101 includes the flow control member 108. The flow control member 108 is displaceable, relative to the port 106, such that the flow control member 108 is positionable in open and closed positions. In this respect, the flow control member 108 is displaceable relative to the port 106 for effecting opening and closing of the port 106. The open position of the flow control member 108 corresponds to an open condition of the port 106. The closed position of the flow control member 108 corresponds to a closed condition of the port 106.

In some embodiments, for example, in the closed position, the port 106 is covered by the flow control member 108, and the displacement of the flow control member 108 to the open position effects at least a partial uncovering of the port 106 such that the port 106 becomes disposed in the open condition. In some embodiments, for example, in the closed position, the flow control member 108 is disposed relative to the port 106 such that a sealed interface is disposed between the passage 104 and the subterranean formation 30, and the disposition of the sealed interface is such that treatment material being supplied through the passage 104 is prevented, or substantially prevented, from being injected, via the port 106, into the subterranean formation 30, and displacement of the flow control member 108 to the open position effects fluid communication, via the port 106, between the passage 104 and the subterranean formation 30, such that treatment material being supplied through the passage 104 is injected into the subterranean formation 30 through the port 106. In some embodiments, for example, the sealed interface is established by sealing engagement between the flow control member 108 and the housing 102. In some embodiments, for example, "substantially preventing fluid flow through the port 106" means, with respect to the port 106, that less than 10 volume %, if any, of fluid treatment (based on the total volume of the fluid treatment) being conducted through the passage 104 is being conducted through the port 106.

In some embodiments, for example, the flow control member 108 includes a sleeve. The sleeve is slideably disposed within the passage 104. In some embodiments, for example, the sleeve has a generally cylindrical inner wall 109.

In some embodiments, for example, the flow control member 108 is displaceable from the closed position (see FIGS. 1A to F) to the open position (see FIGS. 7A to D) and thereby effect opening of the port 106. Such displacement is effected while the flow control apparatus 101 is deployed downhole within a wellbore 10 (such as, for example, as part of a wellbore string 20), and such displacement, and consequential opening of the port 106, enables treatment material, that is being supplied from the surface and through the wellbore 10 via the wellbore string 20, to be injected into the subterranean formation 100 via the port 106. In some embodiments, for example, by enabling displacement of the flow control member 108 between the open and closed positions, pressure management during hydraulic fracturing is made possible.

In some embodiments, for example, the flow control member 108 is displaceable from the open position to the closed position and thereby effect closing of the port 106. Displacing the flow control member 108 from the open position to the closed position may be effected after completion of the supplying of treatment material to the subterranean formation 100 through the port 106. In some embodiments, for example, this enables the delaying of production through the port 106, facilitates controlling of wellbore pressure, and also mitigates ingress of sand from the formation 14 into the casing, while other zones of the subterranean formation 100 are now supplied with the treatment material through other ports 106. In this respect, after sufficient time has elapsed after the supplying of the treatment material to a zone of the subterranean formation 14, such that meaningful fluid communication has become established between the hydrocarbons within the zone of the subterranean formation 14 and the port 106, by virtue of the interaction between the subterranean formation 14 and the treatment material that has been previously supplied into the subterranean formation 14 through the port 106, and, optionally, after other zones of the subterranean formation 14 have similarly become disposed in fluid communication with other ports 106, the flow control member(s) may be displaced to the open position so as to enable production through the wellbore. Displacing the flow control member 108 from the open position to the closed position may also be effected while fluids are being produced from the formation 100 through the port 106, and in response to sensing of a sufficiently high rate of water production from the formation 14 through the port 106. In such case, displacing the flow control member 108 to the closed position blocks, or at least interferes with, further production through the associated port 106.

The flow control member 108 is configured for displacement, relative to the port 106, in response to application of a sufficient force. In some embodiments, for example, the application of a sufficient force is effected by a displacement-actuating pressure differential that is established across the flow control member 108. In some embodiments, for example, the sufficient force, applied to effect opening of the port 106 is a flow control member opening force, and the sufficient force, applied to effect closing of the port 106 is a flow control member closing force.

In some embodiments, for example, the housing 102 includes an inlet 112. While the apparatus 100 is integrated within the wellbore string 20, and while the wellbore string 20 is disposed downhole within a wellbore 10 such that the inlet 112 is disposed in fluid communication with the surface via the wellbore string 20, and while the port 106 is disposed in the open condition, fluid communication is effected between the inlet 112 and the subterranean formation 30 via the port 106, such that the subterranean formation 30 is also disposed in fluid communication, via the port 106, with the surface (such as, for example, a source of treatment fluid) via the wellbore string 20. Conversely, while the port 106 is disposed in the closed condition, at least increased interference to fluid communication, relative to that while the port 14 is disposed in the open condition (and, in some embodiments, sealing, or substantial sealing, of fluid communication), between the inlet 112 and the subterranean formation 30, is effected such that the sealing, or substantial sealing, of fluid communication, between the subterranean formation and the surface, via the port 106, is also effected.

In some embodiments, for example, the housing 102 includes a sealing surface configured for sealing engagement with a flow control member 108, wherein the sealing engagement defines the sealed interface described above. In some embodiments, for example, the sealing surface is defined by sealing members 110A, 110B. In some embodiments, for example, the flow control member 108 co-operates with the sealing members 110A, 110B to effect opening and closing of the port 106. When the port 106 is disposed in the closed condition, the flow control member 108 is sealingly engaged to both of the sealing members 110A, 110B, and thereby preventing, or substantially preventing, treatment material, being supplied through the passage 104, from being injected into the reservoir 30 via the port 106. When the port 106 is disposed in the open condition, the flow control member 108 is spaced apart or retracted from at least one of the sealing members (such as the sealing member 110A), thereby providing a passage for treatment material, being supplied through the passage 104, to be injected into the subterranean formation 30 via the port 106. In some embodiments, for example, each one of the sealing members 110A, 110B, independently, includes an o-ring. In some embodiments, for example, the o-ring is housed within a recess formed within the housing 102. In some embodiments, for example, each one of the sealing members 110A, 110B, independently, includes a molded sealing member (i.e. a sealing member that is fitted within, and/or bonded to, a groove formed within the sub that receives the sealing member).

In some embodiments, for example, the port 106 extends through the housing 102, and is disposed between the sealing surfaces 110A, 110B.

In some embodiments, for example, the flow control apparatus 101 includes a collet (not shown) that extends from the housing 102, and is configured to releasably engage the flow closure member 108 so as to provide resistance to its displacement from selected positions relative to the housing 102 (such as the open and closed positions) such that a minimum predetermined force is required to overcome this resistance to enable displacement of the flow control member between these selected positions.

In some embodiments, for example, while the apparatus 101 is being deployed downhole, the flow control member 108 is maintained disposed in the closed position by one or more shear pins 111. The one or more shear pins are provided to secure the flow control member 108 to the wellbore string 20 (including while the wellbore string 20 is being installed downhole) so that the passage 104 is maintained fluidically isolated from the formation 14 until it is desired to treat the formation 14 with treatment material. To effect the initial displacement of the flow control member 108 from the closed position to the open position, sufficient force must be applied to the one or more shear pins such that the one or more shear pins become sheared, resulting in the flow control member 108 becoming displaceable relative to the port 106. In some operational implementations, the force that effects the shearing is applied by a pressure differential.

The housing 102 additionally includes a shoulder 142 to limit downhole displacement of the flow control member 108.

In some embodiments, for example, the flow control member 108 is configured for displacement, relative to the port 106, in response to application of an opening force that is effected by fluid pressure. In some embodiments, for example, the opening force is effectible while pressurized fluid is disposed uphole of a plug 116 (such as a ball), such that a displacement-actuating fluid pressure differential is established across the plug 116. In this respect, in some embodiments, for example, the flow control member 108 is configured for displacement, relative to the port 106, in response to establishment of a displacement-actuating fluid pressure differential across the plug 116.

The plug 116 is fluid conveyable, and may take the form of a shape that co-operates with its deployment through the wellbore string 20.

In some embodiments, for example, the displacement-actuating fluid pressure differential, that is effectible across the plug 116, is effectible while the plug 116 is disposed within the passage 104 such that a sealed interface is defined within the passage 104, and the displacement-actuating fluid pressure differential, that is effectible across the plug 116, includes that which is effectible across the sealed interface. In this respect, the flow control member 108 is configured for displacement, relative to the port 106, in response to establishment of a displacement-actuating fluid pressure differential across the sealed interface that is defined within the passage 104 while the plug 116 is disposed within the passage 104. The disposition of the sealed interface is such that, when pressurized fluid is supplied to the passage 104, uphole of the sealed interface, the displacement-actuating pressure differential is established across the sealed interface such that application of the opening force is effected such that displacement of the flow control member 108 in a downhole direction (in this case, to effect opening of the port 106) is also effected. The sealed interface is with effect that sealing, or substantial sealing, of fluid communication between an uphole space 105A of the housing passage 104 and a downhole space 105B of the housing passage 104 is effected. In some embodiments, for example, the sealed interface is defined by the sealing, or substantially sealing, disposition of the plug 116 within the passage 104. In this respect, in some embodiments, for example, a portion of the external surface of the plug 116 is defined by a resilient material which functions to enable the plug to be conducted downhole through the wellbore string 20, while enabling the sealing, or substantially sealing, disposition of the plug 116 relative to the passage 104 to define the sealed interface.

In some embodiments, for example, the establishment of the displacement-actuating pressure differential is effectible while the plug 116 is seated on a seat 118 within the wellbore string passage 22 (such as, for example, within the apparatus 100). In this respect, in some embodiments, for example, the flow control member 108 is configured for displacement, relative to the port 106, in response to establishment of a displacement-actuating fluid pressure differential across the plug 116, while the plug 116 is seated on the seat 118 that is defined within the apparatus 100.

In some embodiments, for example, the sealed interface, across which the displacement-actuating pressure differential is effectible for effecting the displacement of the flow control member 108, is effectible while the plug 116 is seated on the seat 118. In this respect, the flow control member 108 is configured for displacement, relative to the port 106, in response to establishment of a displacement-actuating fluid pressure differential across the sealed interface that is defined within the passage 104 while the plug 116 is seated on the seat 118 (see FIGS. 6A to E) that is defined within the passage 104.

The seat 118 is a deployable seat that is mounted to the housing 102. The deployable seat is configured for displacement, relative to the housing 102, from a non-deployed position (see FIGS. 1A to F) to a deployed position (see FIGS. 5A to D).

The deployable seat 118 includes an aperture, and is configured such that, when the seat is deployed in a deployed position, the seat is configured for receiving a respective plug 116 for seating of the respective plug 116 over the aperture of the seat 118. In this respect, each one of the plugs is respective to a deployable seat of a one of the injection stations, such that a plurality of plugs are provided corresponding to the plurality of the injection stations, and such that each one of the plugs is respective to a one of the injection stations.

In some embodiments, for example, the seat 118 is biased for disposition in the deployed position and is retainable in the non-deployed position by a displaceable retainer 130 (see FIG. 1A through F). The retainer 130 is displaceable, relative to the housing 102, between a retaining position and a non-retaining position (see FIGS. 4A though C). When the retainer 130 is disposed in the retaining position (see FIGS. 1A through F), the seat 118 is supported in the non-deployed position by the retainer 130, such that the retainer 130 opposes the biasing force that is urging displacement of the seat 118 from the non-deployed position to the deployed position 32. In this respect, the seat 118 is retained by the retainer 130. In some embodiments, for example, when the retainer 130 is disposed in the retaining position, the seat 118 is prevented from being displaced to the deployed position. When the retainer 130 is disposed in the retaining position, in response to displacement of the retainer 130 from the retaining position, the supporting of the seat 118 in the non-deployed position is suspended, and the seat 118 becomes displaced by the biasing force towards the deployed position. In some embodiments, for example, the biasing force is provided by a resilient member 132, such as, for example, a spring.

In some embodiments, for example, the seat 118 is coupled to the flow control member 108, and the displacement from the non-deployed position to the deployed position is effected by a rotation of the seat 118 relative to the flow control member. In this respect, in some embodiments, for example, the seat 118 is rotatably coupled to the flow control member 108, and in the non-deployed position, the seat 118 is nested within a recess 107 of the flow control member 108.

In some embodiments, for example, the biasing force is urging displacement of the seat 118 along a path, wherein the deployed position is disposed in the path, and a second retainer 134 is provided for opposing the biasing force and preventing the seat 118 from being displaced along the path from the deployed position, when the seat 118 is disposed in the deployed position. In this respect, the retainer 130 is a first retainer, and the second retainer 134 is provided for and opposing the biasing force, when the seat 118 is disposed in the deployed position. In some embodiments, for example, the opposing of the biasing force is such that the seat 118 is retained in the deployed position.

Figure 4C:
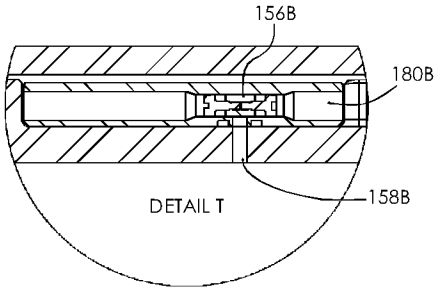
Figure 4B:
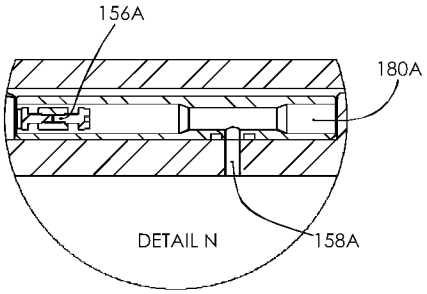
Figure 4A:
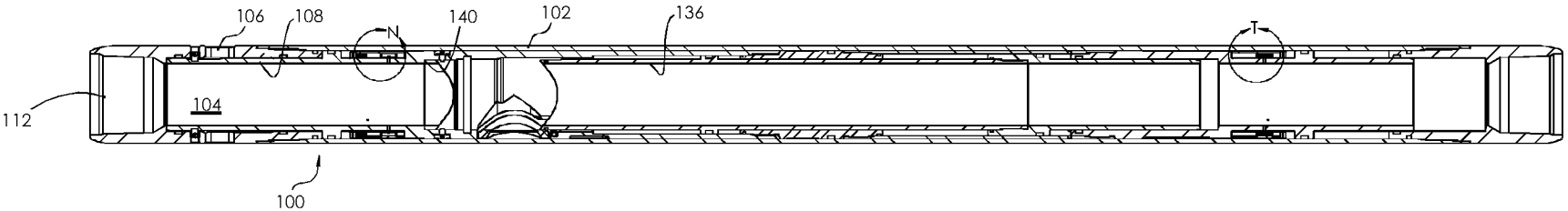
Figure 5D:
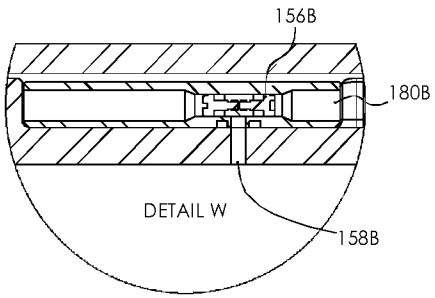
Figure 5C:
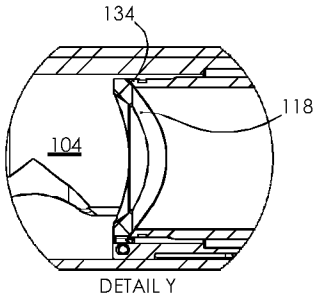
Figure 5B:
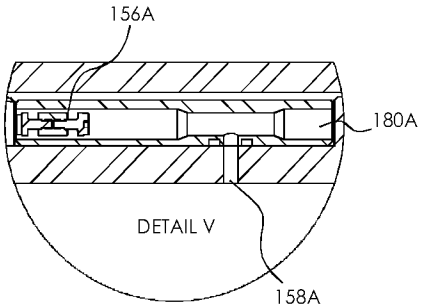
Figure 5A:
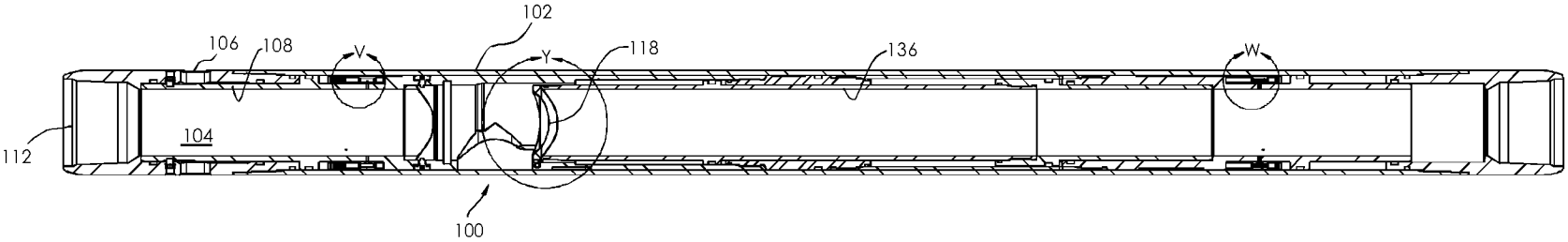
Figure 6E:
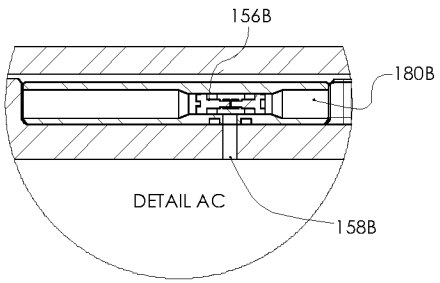
Figure 6D:
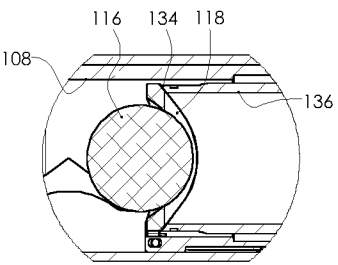
Figure 6C:
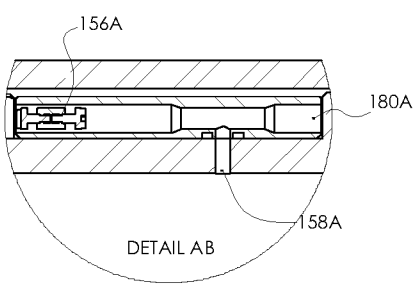
Figure 6B:
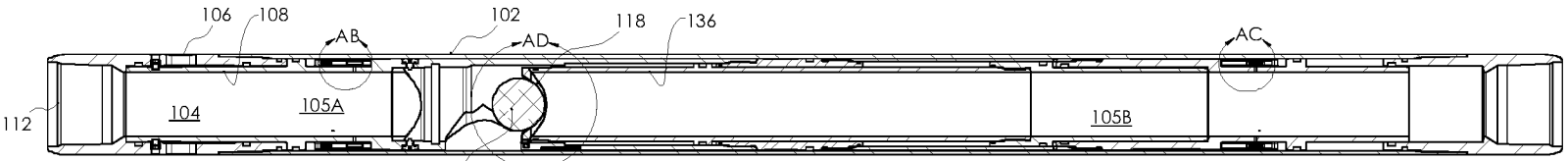
Figure 6A:
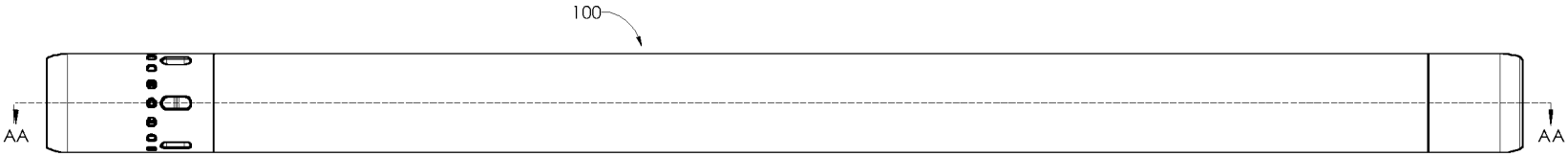
Figure 7D:
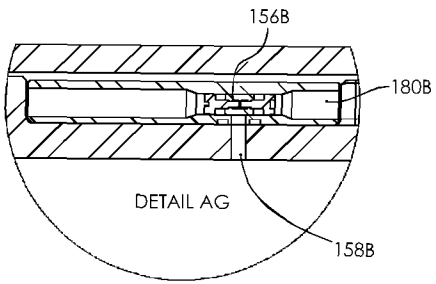
Figure 7C:
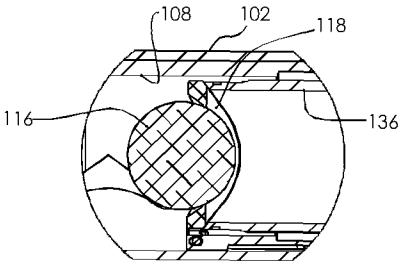
Figure 7B:
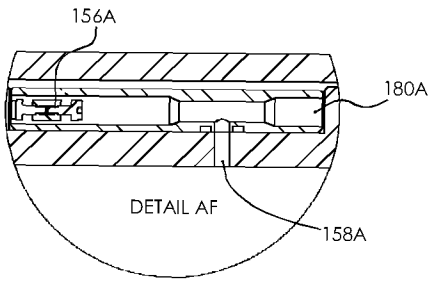
Figure 7A:
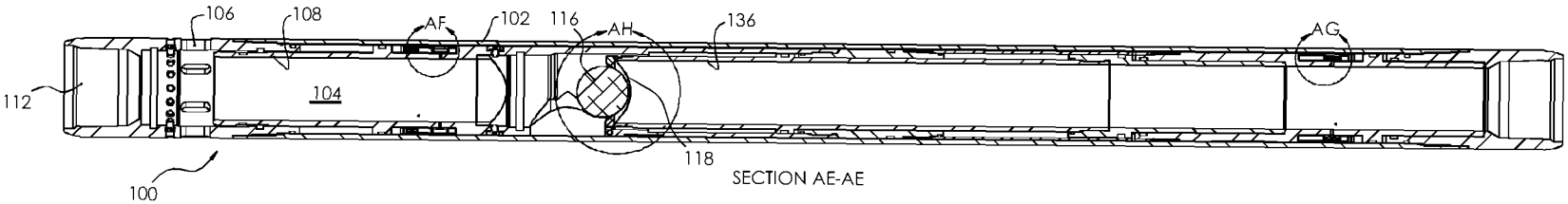
Figure 8D:
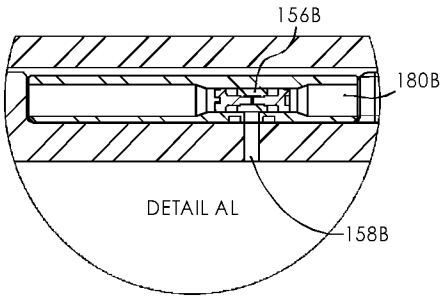
FIG. 8D is a detailed view of Detail "AL" illustrated in FIG. 8A.
Figure 8C:
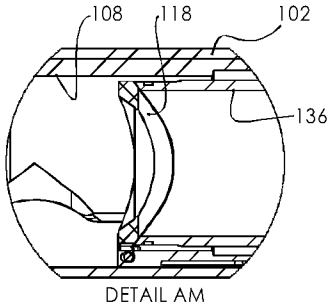
FIG. 8C is a detailed view of Detail "AM" illustrated in FIG. 8A.
Figure 8B:
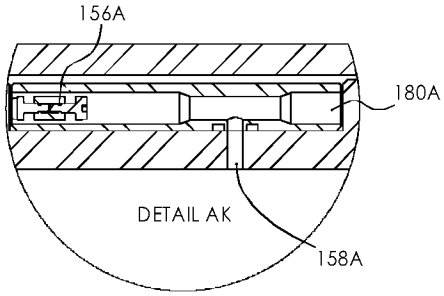
FIG. 8B is a detailed view of Detail "AK" illustrated in FIG. 8A.
Figure 8A:
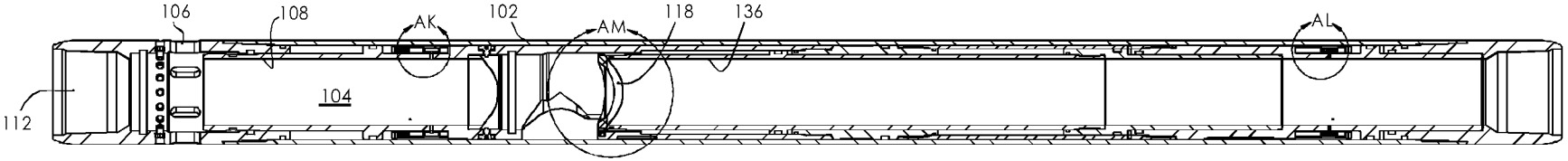
FIG. 8A is a sectional view of the injection station illustrated in FIG. 1A.
Figure 9D:
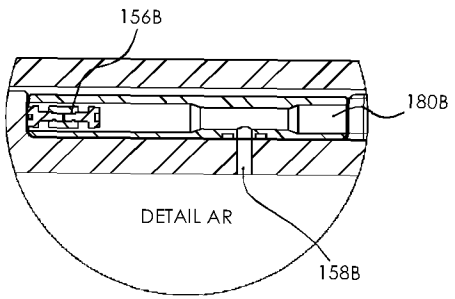
Figure 9C:
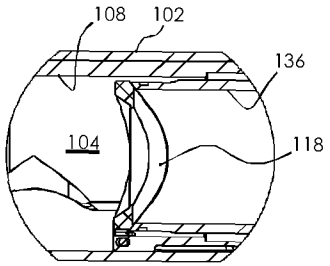
Figure 9B:
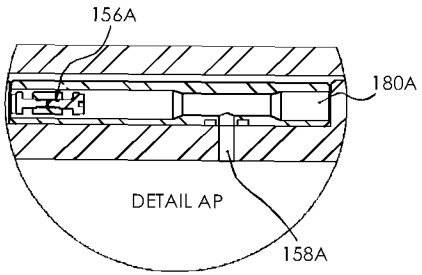
Figure 9A:
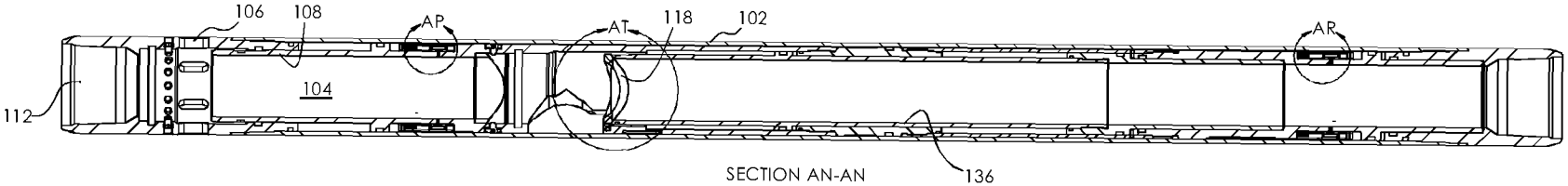
Figure 10D:
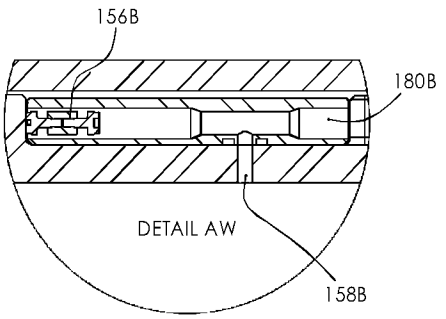
Figure 10C:
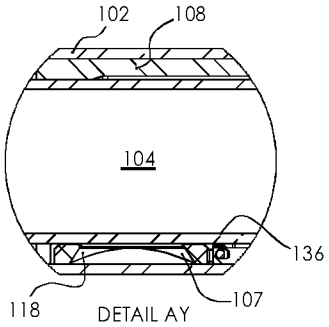
Figure 10B:
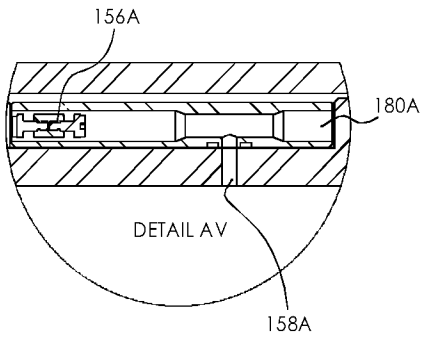
Figure 10A:
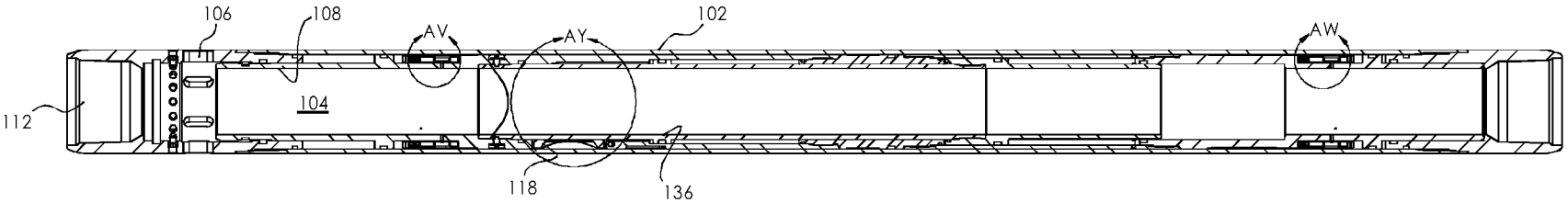

In some embodiments, for example, there is provided a piston 136 that is displaceable, relative to the housing 102, from a first retaining position (see FIGS. 1A through F) to a second retaining position (see FIGS. 4A through C). When the piston 136 is disposed in the first retaining position and the seat is disposed in the non-deployed position, the seat 118 is supported in the non-deployed position by the piston 136, such that the piston 136 is opposing the biasing force that is urging displacement of the seat 118 along a path, and thereby retaining the seat in the non-deployed position. When the piston 136 becomes displaced from the first retaining position, the supporting of the seat 118 in the non-deployed position is suspended, and the seat 118 becomes displaced by the biasing force, along the path, towards the deployed position. When the displacement of the piston 136 from the first retaining position is such that the piston becomes disposed in the second retaining position, and when the seat 118 becomes disposed in the deployed position while the piston 136 is disposed in the second retaining position, the piston 136 opposes the biasing force that is urging displacement of the seat 118 further along the path and from the deployed position, thereby retaining the seat 118 in the deployed position. The displacement of the piston 136 co-operates with the seat 118 such that, after the piston 136 has become displaced from the first retaining position, the seat 118 is displaced by the biasing force, along the path, to the deployed position, and such that the piston 136 is disposed in the second retaining position when the seat 118 becomes disposed in the deployed position.

In some embodiments, for example, the displacement of the piston 136, relative to the housing 102, is limited by a stop 138, such as by a shoulder provided within the housing 102, such as a shoulder on the flow control member 108, and the limiting of the displacement is designed to ensure that the seat 118 is landed on the piston when the seat 118 becomes disposed in the deployed position. In this respect, the displacement of the piston 136, from the first retaining position, is limited to displacement to the second retaining position by the stop 138. In this way, the seat 118 is maintained in a desirable orientation for receiving of the respective plug 116, and is prevented from being displaced (e.g. by rotation) away from this orientation.

In some embodiments, for example, the flow control member 108 includes a flow control member sleeve, and the piston 136 includes a piston sleeve that is disposed within (such as, for example, nested within) the flow control member sleeve and displaceable relative to the flow control member sleeve. In this respect, when disposed in the non-deployed position, the seat 118 is disposed between the flow control member sleeve and the piston sleeve (and, in some embodiments, for example, nested within a recess of the flow control member sleeve), and the piston sleeve is opposing the biasing force being exerted versus the seat 118 and which is urging the displacement of the seat 118 to the deployed position.

In some embodiments, for example, the displacement of the retainer 130 (and, in those embodiments where the retainer is included within the piston 136, the piston) is effected by a seat deployment actuator 150A. In this respect, the seat deployment actuator is configured to transmit an applied force to the retainer (or, as the case may be, piston) for effecting the displacement of the retainer (or piston) relative to the housing 102.

In some embodiments, for example, the seat deployment actuator 150A includes a force transmitter 152A for effecting transmission of an applied force to the retainer 130 for effecting the displacement of the retainer relative to the housing 102 from the retaining position to the non-retaining position. In those cases where the retainer 130 is included within the piston 136, the applied force is for effecting the displacement of the piston relative to the housing 102 from the first retaining position to the second retaining position.

In some embodiments, for example, the force transmitter 152A includes a fluid communication device 154A. The fluid communication device 154A is configured to effect fluid communication between the housing passage 104 and the retainer 130 while pressurized fluid is disposed within the housing passage 104, such that the pressurized fluid, that is communicated from the housing passage 104, via the fluid communication device 154A, to the retainer, applies a force to the retainer 130 such that the displacement of the retainer 130, relative to the housing 102, from the retaining position to the non-retaining position, is effected. In those cases where the retainer 130 is included within the piston 136, the force applied by the pressurized fluid is for effecting the displacement of the piston 136 relative to the housing 102 from the first retaining position to the second retaining position.

In some embodiments, for example, while the apparatus 101 is being deployed downhole, the piston 136 is maintained disposed in the closed position by one or more shear pins 111. The one or more shear pins 136A are provided to secure the flow control member 108 to the wellbore string 20 (including while the wellbore string 20 is being installed downhole. To effect the initial displacement of the piston 136, sufficient force must be applied to the one or more shear pins such that the one or more shear pins become sheared, resulting in the piston 136 becoming displaceable relative to the housing. In some operational implementations, the force that effects the shearing is applied by a pressure differential.

In some embodiments, for example, the fluid communication device 154A includes the fluid communication control valve 156A and the fluid communication passage 158A. The fluid communication passage 158A is provided for effecting fluid communication between the housing passage 104 and the retainer (or, as the case may be, the piston), and thereby effecting the communication of the pressurized fluid.

The establishing of the fluid communication between the housing passage 104 and the retainer is controlled by the positioning of the fluid communication control valve 156A relative to the fluid communication passage 158A. In this respect, the fluid communication control valve 156A is configured for displacement relative to the fluid communication passage 158A. The displacement of the fluid communication control valve 156A is between a closed position (see FIGS. 1A through F) to an open position (see FIGS. 3A through C). When the fluid communication control valve 156A is disposed in the closed position, sealing, or substantial sealing, of fluid pressure communication, between the passage 104 and the retainer 130 (or, as the case may be, the piston 136), via the fluid communication passage 158A, is effected. In some embodiments, for example, when disposed in the closed position, the fluid communication control valve 156A is occluding the fluid communication passage 158A. When the fluid communication control valve 156A is disposed in the open position and pressurized fluid is disposed within the passage 104, fluid communication is effected, via the fluid communication passage 158A, between the passage 104 and the retainer 130 such that the pressurized fluid within the housing passage 104 communicates a force to the retainer 130, thereby effecting the displacement of the retainer 130 relative to the housing 102, from the retaining position to the non-retaining position (see FIGS. 4 through C). In those cases where the retainer 130 is included within the piston 136, the force applied by the pressurized fluid is for effecting the displacement of the piston 136 relative to the housing 102 from the first retaining position to the second retaining position.

In some embodiments, for example, a first chamber 160A is provided for receiving the pressurized fluid communicated from the housing passage 104, and the first chamber 160A is a space that is defined between the flow control member 108 (such as, for example, the flow control member sleeve) and the retainer 130 (or, as the case may be, the piston 136, such as, for example, the piston sleeve). The retainer 130 (or, as the case may be, the piston 136) includes a first force-receiving surface 162A configured for receiving a force applied by the pressurized fluid that is disposed within the first chamber 160A and communicated from the housing passage 104. When applied, the applied force effects the displacement of the retainer 130, relative to the housing 102, from the retaining position to the non-retaining position. In those cases where the retainer 130 is included within the piston 136, the force applied by the pressurized fluid is for effecting the displacement of the piston 136 relative to the housing 102 from the first retaining position to the second retaining position.

In some embodiments, for example, a second chamber 170A is provided for containing a low pressure fluid and communicating the low pressure fluid to the retainer 130 (or, as the case may be, the piston 136). The low pressure fluid has a lower pressure than the pressurized fluid that is being communicated from the housing passage 104, while the pressurized fluid is being communicated from the housing passage 104. In some embodiments, for example, the second chamber is defined between the flow control member 108

(such as, for example, the flow control member sleeve) and the retainer 130 (or, as the case may be, the piston 136, such as, for example, the piston sleeve). In some embodiments, for example, the low pressure fluid has a pressure that is equal to atmospheric pressure. The retainer 130 (or, as the case may be, the piston 136) includes a second force-receiving surface 172A configured for receiving a force being applied by the fluid that is disposed within the second chamber 170A. By configuring the injection station 100 in this manner, opposition to the force that is being applied by the communicated pressurized fluid is mitigated such that opposition to the displacement of the retainer 130 (or, as the case may be, the piston 136).

In some embodiments, for example, the opening of the fluid communication control valve 156A is effected in response to an application of a valve opening force by a valve actuator 180A. In this respect, the application of the valve opening force effects displacement of the fluid communication control valve 156A from the closed position to the open position.

In some embodiments, for example, a biasing force is being applied to the fluid communication control valve 156A and opposes the opening of the fluid communication control valve 156A, such that the application of the valve opening force is effected for overcoming the biasing force. In some embodiments, for example, the biasing force is effected by a resilient member, such as a spring.

In some embodiments, for example, the fluid communication control valve 156A may be suitably pressure balanced such that the fluid communication control valve 156A is disposed in the closed position, and the application of the valve opening force effects a sufficient force imbalance to urge the displacement of the fluid communication control valve 156A from the closed position to the open position.

In some embodiments, for example, the valve actuator 180A includes a gas generator that is electro-mechanically triggered to generate pressurized gas. An example of such an actuator 180A is a squib The squib is configured to, in response to the sensing of a trigger condition, effect generation of pressurized gas. In this respect, the displacement of the fluid communication control valve 156A is effected by the force applied by the generated pressurized gas. Another suitable actuator 180A is a fuse-able link or a piston pusher.

In some embodiments, for example, the opening of the fluid communication control valve 156A is effected in response to the sensing of a trigger condition. In some embodiments, for example, the sensing of the trigger condition effects the application of a valve opening force by the valve actuator 180, thereby urging the displacement of the fluid communication control valve 156A from the closed position to the open position.

A sensor 126 is disposed in fluid pressure communication with the wellbore string fluid passage. In this respect, in some embodiments, for example, the sensor is mounted to the housing 102. The sensor 126 is configured to effect the displacement of the pressure control valve member 24 in response to sensing of a trigger condition, such that the application of a valve opening force by the valve actuator 180A is effected, such that the displacement of the fluid communication control valve 156A from the closed position to the open position is effected, such that fluid pressure communication between the housing passage 16 and the first force-receiving surface is effected, and such that a force is thereby applied to the first force receiving surface such that the applied force effects the displacement of the retainer, relative to the seat 118 (and, in some embodiments, for example, also relative to the flow control member), from the retaining position to the non-retaining position.

In some embodiments, for example, the sensor 126 is a pressure sensor, and the trigger condition is one or more pressure pulses.

An exemplary pressure sensor is a Kellar Pressure Transducer Model 6LHP/81188TM. Other suitable sensors may be employed, depending on the nature of the trigger condition. Other suitable sensors include a Hall effect sensor, a radio frequency identification ("RFID") sensor, or a sensor that can detect a change in chemistry (such as, for example, pH), or radiation levels, or ultrasonic waves.

In some embodiments, for example, the trigger condition is defined by a pressure pulse characterized by at least a magnitude. In some embodiments, for example, the pressure pulse is further characterized by at least a duration. In some embodiments, for example, the trigger condition is defined by a pressure pulse characterized by at least a duration.

In some embodiments, for example, the trigger condition is defined by a plurality of pressure pulses. In some embodiments, for example, the trigger condition is defined by a plurality of pressure pulses, each one of the pressure pulses characterized by at least a magnitude. In some embodiments, for example, the trigger condition is defined by a plurality of pressure pulses, each one of the pressure pulses characterized by at least a magnitude and a duration. In some embodiments, for example, the trigger condition is defined by a plurality of pressure pulses, each one of the pressure pulses characterized by at least a duration. In some embodiments, for example, each one of pressure pulses is characterized by time intervals between the pulses.

Figures 1A, 1B, 1C, 1D, 1E, 1F:
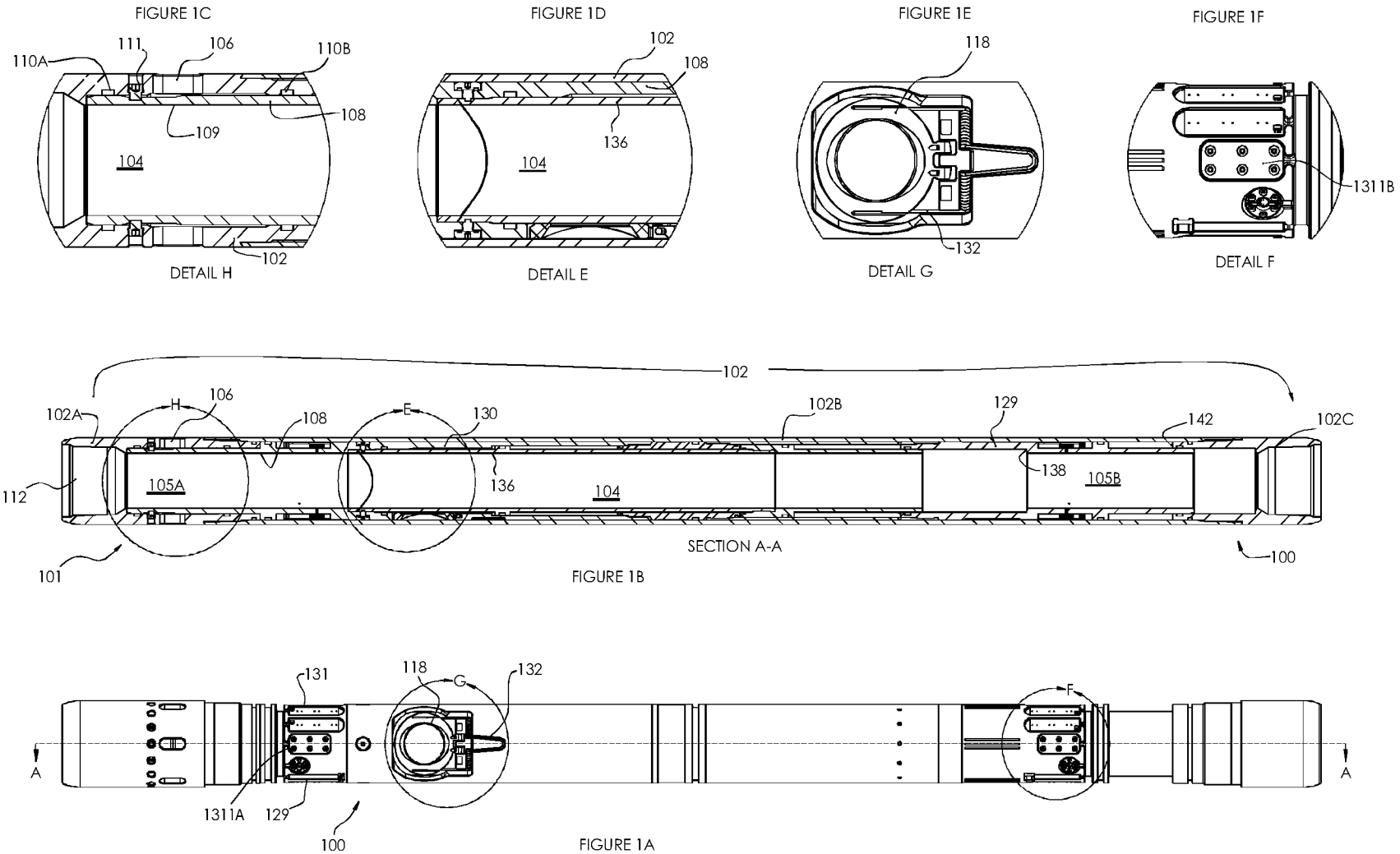
Figure 2D:
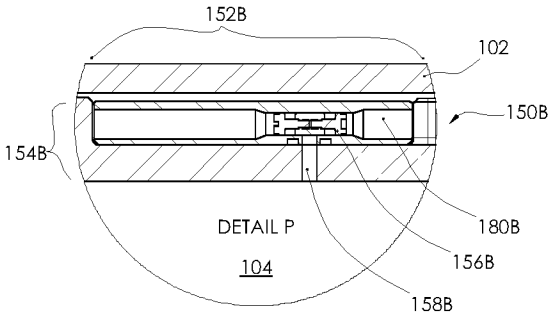
Figure 2C:
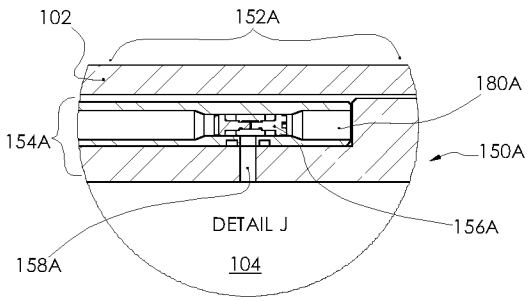
Figure 2B:
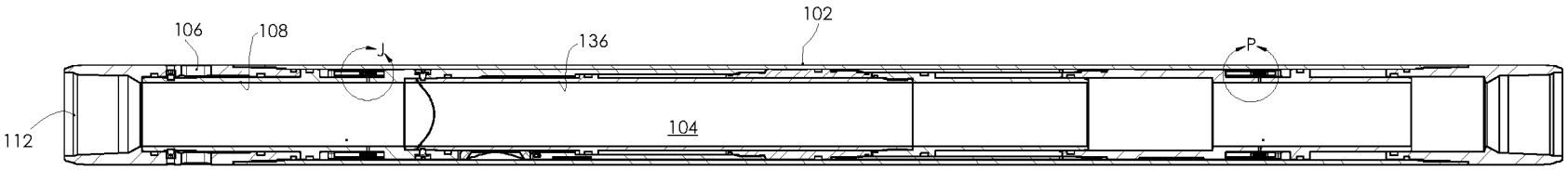
Figure 2A:
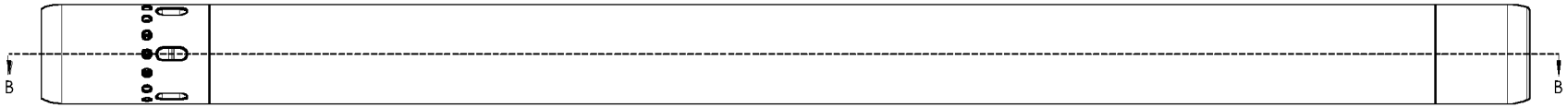
Figure 3C:
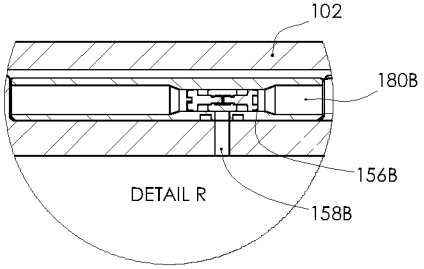
Figure 3B:
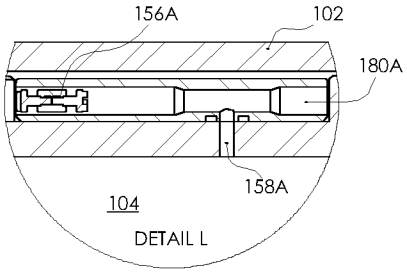
Figure 3A:
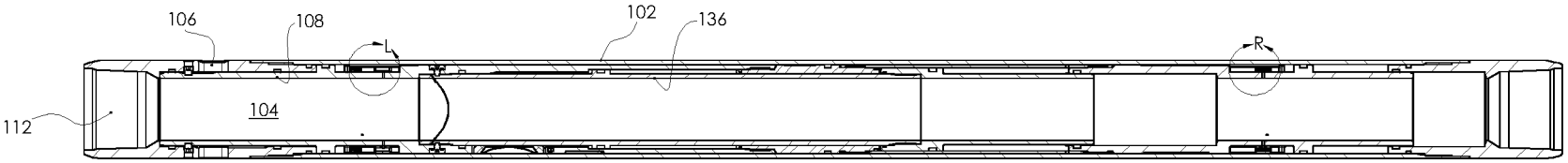

In some embodiments, for example, the flow control apparatus 101 further includes a controller 1311A. The controller 1311A is configured to receive a sensor-transmitted signal from the sensor 126 upon the sensing of the trigger condition. In response to the received sensor-transmitted signal, the controller 1311A supplies an actuation signal to the valve actuator 180A, and the valve actuator 180A effects the displacement of the control valve 156A. In some embodiments, for example, the controller 1311A and the sensor 126 are powered by a battery 131. Referring to FIG. 1F, passages for wiring for electrically interconnecting the battery 131, the sensor 126, and the controller 1311A are provided within an electronics sub 129 of the apparatus 101.

In some embodiments, for example, the trigger condition is common to all of the injection stations of the set of plurality of injection stations. In this respect, upon the sensing of the common trigger condition, the seats of all of the injection stations, of the set of plurality of injection stations, become deployed.

After a plug 116 has been received on a seat 118 of an injection station 100 to which the plug 116 is respective (see FIGS. 6A to E), treatment material is injectable via the injection station 100, upon opening of the port of the injection station 100. In this respect, to effect the opening of the port 106, while the plug 116 is seated on the seat 118, a fluid pressure differential is established across the seat 118, thereby urging the displacement of the flow control member such that the opening of the port 106 is effected. Treatment material, that is supplied and conducted downhole through the wellbore string, is then injectable into the formation via the open port 106. After the formation becomes sufficiently stimulated via all of the injection stations such that sufficient fluid pressure within the formation is communicable to the wellbore to drive flowback upon suspending of the supplying of the treatment material, the supplying of the treatment material is suspended, and flowback is initiated, resulting in production of reservoir fluid from the formation at each one of the injection stations, along with recovery of the plugs that have been deployed downhole for seating on the seats.

After the production has been completed, it may be desirable to retract the deployed seat 118 such that any other kind of wellbore intervention may be practised, or logging equipment may be deployed within the wellbore, without interference that would otherwise be provided by the deployed seats. In this respect, in some embodiments, for example, a seat retraction actuator 150B is provided for effecting the displacement of the piston, relative to the seat 118, so as to effect retraction of the deployed seat 118 such that the occlusion of the wellbore string passage 22, provided by the deployed seat 118, is at least partially removed. In some embodiments, for example, the retraction is such that the seat becomes disposed in the non-deployed position (see FIGS. 10A to D).

In some embodiments, for example, the retraction of the deployed seat 118 is effected by displacement of the piston 136 from the second retaining position to the first retaining position, and such displacement of the piston 136 is effected by the seat retraction actuator 150B. In this respect, the seat retraction actuator 150B is configured to transmit an applied force to the piston 136 for effecting the displacement of the piston 136, relative to the housing 102, from the second retaining position (see FIGS. 9A to D) to the first retaining position (see FIGS. 10A to D). The piston 136 is further configured, such that while: (i) the seat 118 is deployed in the deployed position, and (ii) the piston 136 is being displaced from the second retaining position to the first retaining position, the retraction of the seat 118 to the non-deployed position is urged by the piston 136 (while overcomes the biasing force applied to the seat 118 that is urging maintaining the disposition of the seat 118 in the deployed position), such that, when the piston 136 becomes displaced to the first retaining position, the seat 118 becomes disposed in a retracted position (such as, for example, the non-deployed position) and is supported by the piston 136 (see FIGS. 10A to D). A stop 140 is provided (such as, for example, by a shoulder formed on the flow control member 108) to limit displacement of the piston 136 such that the piston is prevented from being displaced beyond the first retaining position by the seat retraction actuator 150B.

In some embodiments, for example, the seat retraction actuator 150B includes a force transmitter 152B for effecting transmission of an applied force to the piston 136 for effecting the displacement of the piston 136, relative to the seat 118, from the second retaining position to the first retaining position.

In some embodiments, for example, the force transmitter 152B includes a fluid communication device 154B. The fluid communication device 154B is configured to effect fluid communication between the housing passage 104 and the piston 136 while pressurized fluid is disposed within the housing passage, such that the pressurized fluid, that is communicated from the housing passage 104, via the fluid communication device 154B, to the piston 136, applies a force to the piston 136 such that the displacement of the piston 136, relative to the housing 102 is effected.

In some embodiments, for example, the fluid communication device 154B includes the fluid communication control valve 156B and the fluid communication passage 158B The fluid communication passage 158B is provided for effecting fluid communication between the housing passage 104 and the piston 136, and thereby effecting the communication of the pressurized fluid.

The establishing of the fluid communication between the housing passage 104 and the piston 136 is controlled by the positioning of the fluid communication control valve 156B relative to the fluid communication passage 158B. In this respect, the fluid communication control valve 156B is configured for displacement relative to the fluid communication passage 158B. The displacement of the fluid communication control valve 156B is between a closed position (see FIGS. 8A to D) to an open position (see FIGS. 9A to D). When the fluid communication control valve 156B is disposed in the closed position, sealing, or substantial sealing, of fluid pressure communication, between the passage 104 and the piston 136, via the fluid communication passage 158B, is effected. In some embodiments, for example, when disposed in the closed position, the fluid communication control valve 156B is occluding the fluid communication passage 158B. When the fluid communication control valve 156B is disposed in the open position and pressurized fluid is disposed within the passage 104, fluid communication is effected, via the fluid communication passage 158B, between the passage 104 and the piston 136 such that the pressurized fluid within the housing passage 104 communicates a force to the piston 136, thereby effecting the displacement of the piston 136 relative to the housing 102 (and, in some embodiments, for example, also relative to the flow control member) is effected.

In some embodiments, for example, a third chamber 160B is provided for receiving the pressurized fluid communicated from the housing passage 104, and the third chamber 160B is a space that is defined between the flow control member 108 (such as, for example, the flow control member sleeve) and the piston 136 (such as, for example, the piston sleeve). The piston 136 includes a first force-receiving surface 162B configured for receiving a force applied by the pressurized fluid that is disposed within the third chamber 160B and communicated from the housing passage such that the applied force effects the displacement of the piston 136, relative to the housing 102.

In some embodiments, for example, a fourth chamber 170B is provided for containing a low pressure fluid and communicating the low pressure fluid to the piston 136. The low pressure fluid has a lower pressure than the pressurized fluid that is being communicated from the housing passage 104, while the pressurized fluid is being communicated from the housing passage 104. In some embodiments, for example, the fourth chamber is defined between the flow control member 108 (such as, for example, the flow control member sleeve) and the piston 136 (such as, for example, the piston sleeve). In some embodiments, for example, the low pressure fluid has a pressure that is equal to atmospheric pressure. The piston 136 includes a second force-receiving surface 172B configured for receiving a force being applied by the fluid that is disposed within the fourth chamber 170A. By configuring the apparatus in this manner, opposition to the force that is being applied by the communicated pressurized fluid is mitigated such that opposition to the displacement of the piston 136 from the second retaining position to the first retaining position is also mitigated.

In some embodiments, for example, the opening of the fluid communication control valve 156B is effected in response to an application of a valve opening force by a valve actuator 180B. In this respect, the application of the valve opening force effects displacement of the fluid communication control valve 156B from the closed position to the open position.

In some embodiments, for example, a biasing force is being applied to the fluid communication control valve 156B and opposes the opening of the fluid communication control valve 156B, such that the application of the valve opening force is effected for overcoming the biasing force. In some embodiments, for example, the biasing force is effected by a resilient member, such as a spring.

In some embodiments, for example, the fluid communication control valve 156B may be suitably pressure balanced such that the fluid communication control valve 156B is disposed in the closed position, and the application of the valve opening force effects a sufficient force imbalance to urge the displacement of the fluid communication control valve 156B from the closed position to the open position.

In some embodiments, for example, the valve actuator 180B includes a gas generator that is electro-mechanically triggered to generate pressurized gas. An example of such an actuator 180B is a squib The squib is configured to, in response to the sensing of a trigger condition, effect generation of pressurized gas. In this respect, the displacement of the fluid communication control valve 156B is effected by the force applied by the generated pressurized gas. Another suitable actuator 180B is a fuse-able link or a piston pusher.

In some embodiments, for example, the opening of the fluid communication control valve 156B is effected in response to the sensing of a trigger condition. In some embodiments, for example, the sensing of the trigger condition effects the application of a valve opening force by the valve actuator 180B, thereby urging the displacement of the fluid communication control valve 156B from the closed position (see FIGS. 8A to D) to the open position (see FIGS. 9A to D).

In some embodiments, for example, the trigger condition is the same trigger condition that effects the opening of the fluid communication control valve 156A, which effects the displacement of the piston, relative to the seat 118, from the retaining position to the non-retaining position, but the opening of the fluid communication control valve 156B, in response to the sensing of the trigger condition, is delayed by a predetermined time interval. In some embodiments, for example, the predetermined time interval is sufficient for effecting treatment of the subterranean formation via the set of a plurality of injection stations, after the ports of all of the injection stations have been opened, wherein, for each one of the ports, independently, the opening of the port is effected in response to the establishment of a displacement-actuating pressure differential across a plug 116, while the plug 116 is seated on a seat 118 that: (i) has been deployed, and (ii) is respective to the injection station to which the port is respective to, such that the effecting treatment of the subterranean formation via the set of a plurality of injection stations is effected after the seats of all of the injection stations have been deployed. In some embodiments, for example, the delay is effected by the controller 1311B in response to the trigger condition, such as in response to a signal transmitted from the sensor in response to sensing the trigger condition.

Referring to FIG. 11, in some embodiments, for example, there is provided a set of a plurality of injection stations that are integrated into the wellbore string. Each one of the injection stations of the set, independently, is defined by any one of the embodiments of the injection station 100 described above. In some embodiments, for example, the injection stations are identical or substantially identical.

The following is a description of exemplary embodiments of the integration of the plurality of injection stations of the set into the wellbore string. The description is with reference to embodiments where the number of injection station is two (2), and is defined by a first injection station 100 and a second injection station 200. It is understood that the number of injection stations of the set is not limited to two (2) and may be any number of injection stations. Parts of the first injection station 100 are labelled using the same reference numerals as those used for labelling the parts of the injection station 100 illustrated in FIGS. 1 to 10. Parts of the second injection station 200 that are alike with parts of the first injection station 100 are labelled using the same reference numeral incremented by "100". In some embodiments, for example, with the exception of the aperture of the deployable seat (see below), the first and second injection stations 100, 200 are identical, or substantially identical.

Referring to FIG. 11, when, the injection stations (e.g. the injection stations 100, 200) are integrated into the wellbore string such that the wellbore string includes a plurality of longitudinally spaced apart injection stations, the longitudinally spaced apart injection stations include one or more "uphole injection stations". Each one of the one or more uphole injection stations is a one of the one or more injection stations of the longitudinally spaced apart injection stations that is other than the injection station (e.g. the first injection station 100) of the longitudinally spaced apart injection stations that is disposed furthest downhole relative to all of the other ones of the longitudinally spaced apart injection stations (in the illustrated embodiment, there is only one other one longitudinally spaced apart injection station, namely, the second injection station 200).

For each one of the one or more uphole injection stations (in the illustrated embodiment, there is only one uphole injection station, namely, the second injection station 200), independently: one or more injection stations are disposed downhole relative to the uphole injection station to define one or more downhole-disposed injection stations (in the illustrated embodiment, there is only one such injection stations, namely the first injection station 100). Each one of the plugs that is respective to a one of the one or more downhole-disposed injection stations (e.g. the first injection station 100) is described herein as a "downhole-deployable plug" (e.g. the plug 116).

The longitudinally spaced apart injection stations are positionable in a sequence such that for each one of the one or more uphole injection stations (e.g. the second injection station 200), independently: the aperture of the seat (e.g. the seat 218) of the uphole injection station (e.g. the second injection station 200) is co-operable with each one of the one or more downhole-deployable plugs (e.g. the plug 116) that are respective to the one or more downhole-disposed injection stations (e.g. the first injection station 100) that are disposed downhole relative to the uphole injection station (e.g. the second injection station 200), independently, such that, when the wellbore string includes the longitudinally spaced apart injection stations (e.g. the first and second injection stations 100, 200), and when the wellbore string is disposed within a wellbore, and when the seat (e.g. the seat 218) of the uphole injection station (e.g. the second injection station 200) is deployed, for each one of the one or more downhole-deployable plugs (e.g. the plug 116) that are respective to the one or more downhole-disposed injection stations (e.g. the first injection station 100) that are disposed downhole relative to the uphole injection station (e.g. the second injection station 200), independently: when a seat, of the downhole-disposed injection station (e.g. the first injection station 100) to which the downhole-deployable plug (e.g. the plug 116) is respective, is deployed, and when the downhole-deployable plug (e.g. the plug 116) is being conducted downhole through the wellbore string passage, the downhole-deployable plug passes through the aperture of the deployed seat (e.g. the seat 218) of the uphole injection station (e.g. the second injection station 200) and is conducted downhole for seating on the deployed seat (e.g. the seat 118) of the downhole-disposed injection station (e.g. the first injection station 100) to which the downhole-deployable plug (e.g. the plug 116) is respective.

In some embodiments, for example, the injection stations (e.g. the first and second injection stations 100, 200) are integrable within a wellbore string such that the wellbore string includes a plurality of longitudinally spaced apart deployable seats (e.g the seats 118, 218) that are disposed in a sequence. The longitudinally spaced apart deployable seats (e.g. the seats 118, 218) include one or more uphole deployable seats (e.g. the seat 218), wherein each one of the one or more uphole deployable seats is a one of the one or more deployable seats of the longitudinally spaced apart deployable seats that is other than the deployable seat (e.g. the seat 118) of the longitudinally spaced apart deployable seats that is disposed furthest downhole relative to all of the other ones (e.g. the seat 218) of the longitudinally spaced apart deployable seats. In one aspect, when the wellbore string is disposed within a wellbore, each successive deployable seat of the one or more uphole deployable seats (in the illustrated embodiment, this would be only one seat, namely the seat 218), in an uphole direction, includes a larger aperture than the seat (e.g. the seat 118) immediately below it. In another aspect, when the wellbore string is disposed within a wellbore, each successive deployable seat (e.g. the seat 218) of the one or more uphole deployable seats, in an uphole direction, is configured to seat a larger plug than the seat (e.g. the seat 118) immediately below it. In some embodiments, for example, each successive deployable seat of the one or more uphole deployable seats (in the illustrated embodiment, this would be only one seat, namely the seat 218), in an uphole direction, includes a larger dimension than the seat (e.g. the seat 118) immediately below it, such that each successive deployable seat of the longitudinally spaced apart deployable seats, in an uphole direction, is configured to seat a larger plug than the seat immediately below it.

Referring to FIG. 12, in some embodiments, for example, there is provided a first set of a plurality of injection stations and a second set of a plurality of injection stations, and the first and second sets are integrated into a wellbore string.

Each one of the injection stations of the first set, independently, is defined by any one of the embodiments of the injection station 100 described above and illustrated in FIGS. 1 to 10. In some embodiments, for example, the injection stations of the first set are identical or substantially identical. The description of the plurality of injection stations of the first set, which follows, is with reference to embodiments where the number of injection station is two (2), and is defined by a first injection station 100 and a second injection station 200. It is understood that the number of injection stations of the first set is not limited to two (2) and may be any number of injection stations. Parts of the first injection station 100 are labelled using the same reference numerals as those used for labelling the parts of the injection station 100 illustrated in FIGS. 1 to 10. Parts of the second injection station 200 that are alike with parts of the first injection station 100 are labelled using the same reference numeral incremented by "100". The integration of the first set of a plurality of injection stations into the wellbore string is in accordance with respect to any one of the embodiments of the integration of the set of a plurality of injection stations described above (of which FIG. 11 is illustrative).

Each one of the injection stations of the second set, independently, is also defined by any one of the embodiments of the injection station 100 described above and illustrated in FIGS. 1 to 10. In some embodiments, for example, the injection stations of the second set are identical or substantially identical. The description of the plurality of injection stations of the second set, which follows, is with reference to embodiments where the number of injection station is two (2), and is defined by a third injection station 300 and a second injection station 400. It is understood that the number of injection stations of the second set is not limited to two (2) and may be any number of injection stations. Parts of the third injection station 300 that are alike with parts of the first injection station 100 are labelled using the same reference numeral incremented by "200" (such that parts of third injection station 300 that are alike with parts of the second injection station 200 are labelled using the same reference numeral incremented by "100"). Parts of the third injection station 400 that are alike with parts of the first injection station 100 are labelled using the same reference numeral incremented by "300" (such that: (i) parts of fourth injection station 300 that are alike with parts of the second injection station 200 are labelled using the same reference numeral incremented by "200", and (ii) parts of fourth injection station 300 that are alike with parts of the third injection station 300 are labelled using the same reference numeral incremented by "100"). In some embodiments, for example, with the exception of the aperture of the deployable seat (see below), the third and fourth injection stations are identical, or substantially identical. The sensors of the injection stations 300, 400 of the second set are responsive to a different trigger condition than the trigger condition to which the sensors of the injection stations 100, 200 of the first set is responsive to, and are also configured to ignore the trigger condition to which the sensors of the injection stations 100, 200 of the first set are responsive to such that the respective seats 316, 416 of the injection stations 300, 400 of the second set remain disposed in the non-deployed position while the seats 116, 216 are being deployed in response to sensing of the trigger condition respective to the first and second injection stations 100, 200, The integration of the second set of a plurality of injection stations into the wellbore string is in accordance with respect to any one of the embodiments of the integration of the set of a plurality of injection stations into the wellbore string described above (of which FIG. 11 is illustrative) and, as such, is also in accordance with the integration of the first set of plurality of injection stations into the wellbore string.

In one aspect, for each one of the injection stations (e.g. the third and fourth injection stations 300, 400) of the second set: the deployable seat (e.g. the seat 318 or the seat 418) is configured for displacement between a non-deployed position and the deployed position, and in the non-deployed position, when the wellbore string includes a plurality of longitudinally spaced apart injection stations (e.g. the first and second injection stations 100, 200) of the first set and a plurality of longitudinally spaced apart injection stations (e.g. the third and fourth injection stations 300, 400) of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations (e.g. the injection stations 300, 400) of the second set is disposed uphole relative to the plurality of longitudinally spaced apart injection stations (e.g. the first and second injection stations 100, 200) of the first set, and when a plug (e.g. the plug 118 or the plug 218), that is respective to one of the injection stations (e.g. one of the first and second injection stations 100, 200) of the first set, is being conducted downhole through the wellbore string passage, and when the seat (e.g. the seat 118 or the seat 218) of the injection station (e.g. the one of the first and second injection stations 100, 200) of the first set, to which the downhole-conducted plug (e.g. the plug 118 or the plug 218) is respective, is deployed in the deployed position, the deployable seat (e.g. the seat 318 or the seat 418) of the injection station (e.g. one of the third and fourth injection stations 300, 400) of the second set is configured to co-operate with the downhole-conducted plug (e.g. the plug 116 or the plug 216) such that the plug passes the injection station (e.g. the one of the third and fourth injection stations 300, 400) of the second set, and is conducted downhole for seating on the deployed seat (e.g. the seat 118 or the seat 218) of the injection station (the one of the first and second injection stations 100, 200) of the first set to which the downhole-conducted plug (e.g. the plug 116 or the plug 118) is respective.

In another aspect, for at least one of the injection stations (e.g. at least one of the third and fourth injection stations 300, 400) of the second set: the deployable seat (e.g. the seat 318 or the seat 418) of the injection station (e.g. one of the third and fourth injection stations) of the second set is configured such that, when disposed in the deployed position, and when the wellbore string includes a plurality of longitudinally spaced apart injection stations (e.g. the first and second injection stations 100, 200) of the first set and a plurality of longitudinally spaced apart injection stations (e.g. the third and fourth injection stations 300, 400) of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations (e.g. the third and fourth injection stations 300, 400) of the second set is disposed uphole relative to the plurality of longitudinally spaced apart injection stations (e.g. the first and second injection stations) of the first set, conduction of at least one of the plugs (e.g. the plug 116 or the plug 216) of the first set, from uphole of the injection station (e.g. the one of the third and fourth injection stations 300, 400) of the second set and in a downhole direction through the wellbore string passage, for seating on a deployed seat (e.g. the seat 118 or the seat 218) of an injection station (e.g. one of the first and second injection stations 100, 200) of the first set, is prevented.

In another aspect, for any one of the injection stations (e.g. the third and fourth injection stations 300, 400) of the second set: the deployable seat of the injection station (e.g. one of the third and fourth injection stations) of the second set is configured such that, when disposed in the deployed position, and when the wellbore string includes a plurality of longitudinally spaced apart injection stations (e.g. the first and second injection stations 100, 200) of the first set and a plurality of longitudinally spaced apart injection stations (e.g. the third and fourth injection stations 300, 400) of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations (e.g. the third and fourth injection stations 300, 400) of the second set is disposed uphole relative to the plurality of longitudinally spaced apart injection stations (e.g. the first and second injection stations) of the first set, conduction of at least one of the plugs (e.g. the plug 116 or the plug 216) of the first set, from uphole of the injection station (e.g. the one of the third and fourth injection stations 300, 400) of the second set and in a downhole direction through the wellbore string passage, for seating on a deployed seat of an injection station (e.g. one of the first and second injection stations 100, 200) of the first set, is prevented.

An exemplary process for supplying treatment fluid to a subterranean formation, through a wellbore string 20, disposed within a wellbore, and incorporating the first and second sets of injection stations, in accordance with any one of the above-described embodiments, will now be described. The description which follows is with reference to embodiments where: (i) the number of injection stations in the first set is two (2), and is defined by the first injection station 100 and the second injection station 200, and (ii) the number of injection stations in the second set is two (2), and is defined by the third injection station 300 and the fourth injection station 400. It is understood that the number of injection stations of the first set is not limited to two (2) and may be any number of injection stations. It is also understood that the number of injection stations of the second set is not limited to two (2) and may be any number of injection stations.

A first pressure pulse, representative of a first trigger condition, to which the sensors 126, 226 of the first set of injection stations 100, 200 is responsive, is transmitted by fluid through the wellbore string, effecting deployment of the seats 116, 216 of the injection stations 100, 200 of the first set. The sensors 326, 426 of the injection stations 300, 400 of the second set ignore the transmitted pressure pulse, such that the seats 316, 416 remain disposed in the non-deployed position.

While the seats 116, 216 are disposed in the deployed position, the plug 116 is conducted downhole (such as being pumped with flowing fluid) through the wellbore string 20 (disposed within the wellbore 10), passing through the deployed seat 216 and landing on the seat 118. Once the plug 116 is seated on the seat 118, pressurized fluid is supplied uphole of the seated first plug 116 such that the flow control member 108 becomes displaced to the open position. Treatment fluid is then supplied to the subterranean formation through the first port 106 to effect treatment of the zone of the subterranean formation in the vicinity of the port 106.

After the supplying of treatment fluid through the port 106 has been completed, the plug 216 is conducted downhole (such as being pumped with flowing fluid) through the wellbore string 20, and lands on the seat 218. Instead of applying a pressure differential across the seated plug 216 for effecting opening of the flow control member 208, a second pressure pulse, representative of a second trigger condition, to which the sensors 326, 426 of the injection stations 300, 400 of the second set are responsive, is transmitted by fluid through the wellbore string, effecting deployment of the seats 316, 416 of the injection stations 300, 400 of the second set. If the flow control member 208 is opened prior to the transmission of the second pressure pulse, it may be difficult, if not impossible, to co-ordinate the transmission of a pressure pulse that would be detectable by the sensors 326, 426, and to which the sensors 326, 426 would be responsive by effecting deployment of the seats 316, 416, due to the fact that fluid communication would have been established between the wellbore string passage and the subterranean formation via the port 206.

After the seats 316, 416 have been deployed, pressurized fluid is supplied uphole of the seated second plug 216 such that the flow control member 208 becomes displaced to the open position. Treatment fluid is then supplied to the subterranean formation through the second port 206 to effect treatment of the zone of the subterranean formation in the vicinity of the port 206.

After the supplying of treatment fluid through the port 206 has been completed, the plug 316 is conducted downhole (such as being pumped with flowing fluid) through the wellbore string 20, and lands on the seat 318. Once the plug 316 is seated on the seat 318, pressurized fluid is supplied uphole of the seated plug 316 such that the flow control member 308 becomes displaced to the open position. Treatment fluid is then supplied to the subterranean formation through the first port 306 to effect treatment of the zone of the subterranean formation in the vicinity of the port 306.

Likewise, after the supplying of treatment fluid through the port 306 has been completed, the plug 416 is conducted downhole (such as being pumped with flowing fluid) through the wellbore string 20, and lands on the seat 418. Once the plug 416 is seated on the seat 418, pressurized fluid is supplied uphole of the seated plug 416 such that the flow control member 408 becomes displaced to the open position. Treatment fluid is then supplied to the subterranean formation through the first port 406 to effect treatment of the zone of the subterranean formation in the vicinity of the port 406.

After the supplying of treatment fluid through the port 406 has been completed, fluid pressure is maintained in the wellbore string passage such that sufficient time is provided for interaction between the treatment fluid and the subterranean formation for effecting desired stimulation of production. After sufficient time has passed, flowback is initiated, whereby the wellbore string passage is depressurized, resulting in flowback of the plugs 116, 216, 316, and 416, and thereby enabling production of reservoir fluid through the wellbore string passage.

After production has been completed, in some embodiments, for example, and as above-described, the seats 116, 216, 316, 416 may become retracted, in response to urging by a respective piston that is being displaced by a respective seat retraction actuator. As described above, the displacement of the piston by the seat retraction actuator is responsive to the sensing of the same trigger condition that has effected the deployment of the seats, but is delayed by a predetermined time interval so as to enable sufficient time for supplying treatment fluid to the subterranean formation for stimulating production and then producing reservoir fluid from the subterranean formation.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A plurality of injection stations, wherein each one of the injection stations, independently, comprising:

a housing;

a port extending through the housing;

a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, coupled to the flow control member, and including an aperture, and configured such that, when the seat is deployed in a deployed position, the seat is configured for receiving a respective plug for seating of the respective plug over the aperture of the seat;

such that a plurality of plugs are respective to the injection stations, wherein each one of the plugs is respective to a deployable seat of a one of the injection stations, such that each one of the plugs is respective to a one of the injection stations;

wherein:

the injection stations are integratable into a wellbore string such that the wellbore string includes a plurality of longitudinally spaced apart injection stations;

the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations;

for each one of the one or more uphole injection stations, independently:

one or more injection stations are disposed downhole relative to the uphole injection station to define one or more downhole-disposed injection stations, wherein each one of the plugs that is respective to a one of the one or more downhole-disposed injection stations is a downhole-deployable plug;

the longitudinally spaced apart injection stations are positionable in a sequence such that for each one of the one or more uphole injection stations, independently:

the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently:

when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

2. The plurality of injection stations as claimed in claim 1;

wherein, for each one the injection stations:

the flow control member is configured to be displaceable, when the seat is disposed in the deployed position and the respective plug is seated on the deployed seat, in response to the establishment of a fluid pressure differential across the seated plug.

3. The plurality of injection stations as claimed in claim 2;

wherein, for each one the injection stations:

the deployable seat is configured for displacement from a non-deployed position to a deployed position, wherein, in the deployed position, the seat is configured to receive the respective plug such that the seating of the respective plug over the aperture of the seat is effected.

4. The plurality of injection stations as claimed in claim 3;

wherein each one the injection stations further comprises an injection station fluid passage disposed within the housing and configured for defining a portion of the wellbore string passage when the injection station is integrated within the wellbore string.

5. The plurality of injection stations as claimed in claim 1, wherein for each one of the injection stations, independently:

the deployable seat is biased for displacement to the deployed position; and each one of the injection stations, independently, includes:

a first retainer for retaining the deployable seat in a non-deployed position, wherein the retainer is displaceable relative to the flow control member such that the seat becomes disposed in the deployed position.

6. The plurality of injection stations as claimed in claim 5, wherein:

the biasing of the deployable seat is effected by a biasing force that is urging displacement of the seat along a path, wherein the deployed position is disposed in the path; and further comprising:

a second retainer for opposing the biasing force and preventing the seat from being displaced along the path from the deployed position, when the seat is disposed in the deployed position.

7. The plurality of injection stations as claimed in claim 6, further comprising:

a seat deployment actuator configured to effect displacement of the first retainer relative to the flow control member, wherein the seat deployment actuator includes a fluid communication device configured to effect fluid communication between the housing passage and the first retainer while pressurized fluid is disposed within the housing passage, such that the pressurized fluid, that is communicated from the housing passage, via the fluid communication device, to the first retainer, applies a force to the retainer such that the displacement of the first retainer, relative to the flow control member, is effected.

8. The plurality of injection stations as claimed in claim 6, further comprising:

a seat deployment actuator configured to transmit an applied force to the first retainer for effecting displacement of the retainer relative to the flow control member from a retaining position to a non-retaining position.

9. The plurality of injection stations as claimed in claim 1, wherein for each one of the injection stations, independently:

the deployable seat is biased for displacement to the deployed position; and each one of the injection stations, independently, includes:

a piston for retaining the deployable seat in a non-deployed position, wherein the piston is displaceable relative to the flow control member such that the seat becomes disposed in the deployed position.

10. The plurality of injection stations as claimed in claim 9, wherein:

the biasing of the deployable seat is effected by a biasing force that is urging displacement of the seat along a path, wherein the deployed position is disposed in the path; and the piston is displaceable from a first retaining position to a second retaining position;

the displacement of the piston co-operates with the seat such that, after the piston has become displaced from the first retaining position, the seat is displaced by the biasing force, along the path, to the deployed position, and such that the piston is disposed in the second retaining position when the seat becomes disposed in the deployed position such that the piston is opposing the biasing force that is urging the displacement of the seat along the path.

11. The plurality of injection stations as claimed in claim 10, further comprising:

a seat deployment actuator configured to effect displacement of the piston relative to the flow control member, wherein the seat deployment actuator includes a fluid communication device configured to effect fluid communication between the housing passage and the piston while pressurized fluid is disposed within the housing passage, such that the pressurized fluid, that is communicated from the housing passage, via the fluid communication device, to the piston, applies a force to the piston such that the displacement of the retainer, relative to the flow control member, is effected.

12. The plurality of injection stations as claimed in claim 5, wherein:

the displacement from the non-deployed position to the deployed position is effected by a rotation of the seat relative to the flow control member.

13. The plurality of injection stations as claimed in claim 12, wherein:

the seat is rotatably coupled to the flow control member; and while the seat is disposed in the non-deployed position, the seat is nested within a recess of the flow control member.

14. An injection station kit comprising the plurality of injection stations as claimed in claim 4, and further comprising:

a sensor configured for sensing a transmitted deployment actuation signal; and controller configured to effect deployment of all of the seats in response to the sensed deployment actuation signal.

15. A plurality of injection stations configured for integration within a wellbore string comprising:

a first set of injection stations, wherein each one of the first set of injection stations includes:

a housing;

a port extending through the housing;

a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, coupled to the flow control member and including an aperture, and configured such that, when the seat is deployed in a deployed position, the first seat is configured for receiving a respective plug for seating of the respective plug over the aperture of the seat;

such that a plurality of plugs are respective to the injection stations, wherein each one of the plugs is respective to a deployable seat of a one of the injection stations, such that each one of the plugs is respective to a one of the injection stations;

wherein:

the injection stations are integratable into a wellbore string such that the wellbore string includes a plurality of longitudinally spaced apart injection stations;

the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations;

for each one of the one or more uphole injection stations, independently:

one or more injection stations are disposed downhole relative to the uphole injection station to define one or more downhole-disposed injection stations, wherein each one of the plugs that is respective to a one of the one or more downhole-disposed injection stations is a downhole-deployable plug;

the longitudinally spaced apart injection stations are positionable in a sequence such that for each one of the one or more uphole injection stations, independently:

the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently:

when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective;

and a second set of injection stations, wherein each one of the second set of injection stations includes:

a housing;

a port extending through the housing;

a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, coupled to the flow control member, and including an aperture, and configured such that, when the seat is deployed in a deployed position, the seat is configured for receiving a respective plug for seating of the respective plug over the aperture of the seat;

such that a plurality of plugs are respective to the injection stations, wherein each one of the plugs is respective to a deployable seat of a one of the injection stations, such that each one of the plugs is respective to a one of the injection stations;

wherein:

the injection stations are integratable into a wellbore string such that the wellbore string includes a plurality of longitudinally spaced apart injection stations;

the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations;

for each one of the one or more uphole injection stations, independently:

one or more injection stations are disposed downhole relative to the uphole injection station to define one or more downhole-disposed injection stations, wherein each one of the plugs that is respective to a one of the one or more downhole-disposed injection stations is a downhole-deployable plug;

the longitudinally spaced apart injection stations are positionable in a sequence such that for each one of the one or more uphole injection stations, independently:

the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently:

when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

16. The plurality of injection stations as claimed in claim 15;

wherein for each one of the injection stations of the second set:

the deployable seat is configured for displacement between a non-deployed position and the deployed position, wherein, in the non-deployed position, when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, and when a plug, that is respective to one of the injection stations of the first set, is being conducted downhole through the wellbore string passage, and when the seat of the injection station of the first set, to which the downhole-conducted plug is respective, is deployed in the deployed position, the deployable seat of the injection station of the second set is configured to co-operate with the downhole-conducted plug such that the plug passes the injection station of the second set, and is conducted downhole for seating on the deployed seat of the injection station of the first set to which the downhole-conducted plug is respective.

17. A plurality of injection stations as claimed in claim 16;

wherein for at least one of the injection stations of the second set:

the deployable seat of the injection station of the second set is configured such that, when disposed in the deployed position, and when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, conduction of at least one of the plugs of the first set, from uphole of the injection station of the second set and in a downhole direction through the wellbore string passage, for seating on a deployed seat of an injection station of the first set, is prevented.

18. A plurality of injection stations as claimed in claim 16;

wherein for each one of the injection stations of the second set:

the deployable seat of the injection station of the second set is configured such that, when the deployable seat of the injection station of the second set is disposed in the deployed position, and when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, conduction of at least one of the plugs of the first set, from uphole of the injection station of the second set and in a downhole direction through the wellbore string passage, for seating on a deployed seat of an injection station of the first set, is prevented.

19. First and second sets of injection system kits comprising:

a first set of injection system kits, wherein the first set of injection system kits includes a plurality of injection system kits, wherein each one of the injection system kits, independently, includes:

a plug; and an injection station including:

a housing;

a port extending through the housing;

a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, coupled to the flow control member, and including an aperture, and configured such that, when the seat is deployed in a deployed position, the seat is configured for receiving the plug for seating of the plug over the aperture of the seat;

wherein the plug is respective to the injection station;

such that a plurality of plugs are respective to a plurality of injection stations, wherein each one of the plugs is respective to a deployable seat of a one of the injection stations, such that each one of the plugs is respective to a one of the injection stations;

wherein:

the injection stations are integratable into a wellbore string such that the wellbore string includes a plurality of longitudinally spaced apart injection stations;

the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations;

for each one of the one or more uphole injection stations, independently:

one or more injection stations are disposed downhole relative to the uphole injection station to define one or more downhole-disposed injection stations, wherein each one of the plugs that is respective to a one of the one or more downhole-disposed injection stations is a downhole-deployable plug;

the longitudinally spaced apart injection stations are positionable in a sequence such that for each one of the one or more uphole injection stations, independently:

the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently:

when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective;

and a second set of injection system kits, wherein the second set of injection system kits includes a plurality of injection system kits, wherein each one of the injection system kits, independently, includes:

a plug; and an injection station including:

a housing;

a port extending through the housing;

a flow control member configured for displacement for effecting at least opening of the port such that, when the injection station is integrated within a wellbore string that is disposed within a wellbore of a subterranean formation, and treatment fluid is being supplied through a wellbore string passage of the wellbore string, injection of the supplied treatment fluid into the subterranean formation is effected through the port; and a deployable seat, coupled to the flow control member, and including an aperture, and configured such that, when the seat is deployed in a deployed position, the seat is configured for receiving the plug for seating of the plug over the aperture of the seat;

wherein the plug is respective to the injection station;

such that a plurality of plugs are respective to a plurality of injection stations, wherein each one of the plugs is respective to a deployable seat of a one of the injection stations, such that each one of the plugs is respective to a one of the injection stations;

wherein:

the injection stations are integratable into a wellbore string such that the wellbore string includes a plurality of longitudinally spaced apart injection stations;

the longitudinally spaced apart injection stations include one or more uphole injection stations, wherein each one of the one or more uphole injection stations is a one of the one or more injection stations of the longitudinally spaced apart injection stations that is other than the injection station of the longitudinally spaced apart injection stations that is disposed furthest downhole relative to all of the other ones of the longitudinally spaced apart injection stations;

for each one of the one or more uphole injection stations, independently:

one or more injection stations are disposed downhole relative to the uphole injection station to define one or more downhole-disposed injection stations, wherein each one of the plugs that is respective to a one of the one or more downhole-disposed injection stations is a downhole-deployable plug;

the longitudinally spaced apart injection stations are positionable in a sequence such that for each one of the one or more uphole injection stations, independently:

the aperture of the seat of the uphole injection station is co-operable with each one of the one or more downhole-deployable plugs that are respective to the one or more downhole-disposed injection stations that are disposed downhole relative to the uphole injection station, independently, such that, when the wellbore string includes the longitudinally spaced apart injection stations, and when the wellbore string is disposed within a wellbore, and when the seat of the uphole injection station is deployed, for each one of the one or more downhole-deployable plugs that are respective to the one or more downhole-disposed injection stations that are disposed downhole relative to the uphole injection station, independently:

when a seat, of the downhole-disposed injection station to which the downhole-deployable plugs is respective, is deployed, and when the downhole-deployable plug is being conducted downhole through the wellbore string passage, the downhole-deployable plug passes through the aperture of the deployed seat of the uphole injection station and is conducted downhole for seating on the deployed seat of the downhole-disposed injection station to which the downhole-deployable plug is respective.

20. The first and second sets of injection system kits as claimed in claim 19;

wherein for each one of the injection stations of the second set:

the deployable seat is configured for displacement between a non-deployed position and the deployed position, wherein, in the non-deployed position, when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, and when a plug, that is respective to one of the injection stations of the first set, is being conducted downhole through the wellbore string passage, and when the seat of the injection station of the first set, to which the downhole-conducted plug is respective, is deployed in the deployed position, the seat of the injection station of the second set is configured to co-operate with the downhole-conducted plug such that the plug passes the injection station of the second set, and is conducted downhole for seating on the deployed seat of the injection station of the first set to which the downhole-conducted plug is respective.

21. The first and second sets of injection system kits as claimed in claim 20;

wherein for at least one of the injection stations of the second set:

the deployable seat of the injection station of the second set is configured such that, when the deployable seat of the injection station of the second set is disposed in the deployed position, and when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, conduction of at least one of the plugs of the first set, from uphole of the injection station of the second set and in a downhole direction through the wellbore string passage, for seating on a deployed seat of an injection station of the first set, is prevented.

22. The first and second sets of injection system kits as claimed in claim 20;

wherein for each one of the injection stations of the second set:

the deployable seat of the injection station of the second set is configured such that, when the deployable seat of the injection station of the second set is disposed in the deployed position, and when the wellbore string includes a plurality of longitudinally spaced apart injection stations of the first set and a plurality of longitudinally spaced apart injection stations of the second set, wherein the plurality of longitudinally spaced apart injection stations of the first set is longitudinally spaced apart from the plurality of longitudinally spaced apart injection stations of the second set, and when the wellbore string is disposed within the wellbore such that the plurality of longitudinally spaced apart injection stations of the second set is disposed uphole relative to the plurality of longitudinally spaced apart injection stations of the first set, conduction of at least one of the plugs of the first set, from uphole of the injection station of the second set and in a downhole direction through the wellbore string passage, for seating on a deployed seat of an injection station of the first set, is prevented.

* * * * *